US007341654B2

(12) United States Patent
Twardowski et al.

(10) Patent No.: US 7,341,654 B2
(45) Date of Patent: Mar. 11, 2008

(54) MEDIATED HYDROHALIC ACID ELECTROLYSIS

(75) Inventors: Zbigniew Twardowski, Vancouver (CA); Thomas Drackett, Vancouver (CA); Stuart R. Harper, Ottawa (CA)

(73) Assignee: Aker Kvaerner Canada Inc., Vancouver (CA)

( * ) Notice: Subject to any disclaimer, the term of this patent is extended or adjusted under 35 U.S.C. 154(b) by 697 days.

(21) Appl. No.: 10/442,137

(22) Filed: May 21, 2003

(65) Prior Publication Data

US 2004/0074780 A1 Apr. 22, 2004

(51) Int. Cl.
*C25B 1/24* (2006.01)

(52) U.S. Cl. ..... 205/618; 205/620; 205/621; 205/622; 205/624

(58) Field of Classification Search ..... 205/620, 205/621, 622, 624, 625, 618
See application file for complete search history.

(56) References Cited

U.S. PATENT DOCUMENTS

| | | | | |
|---|---|---|---|---|
| 2,468,766 A | | 5/1949 | Low | 204/128 |
| 2,666,024 A | | 1/1954 | Low et al. | 204/128 |
| 3,635,804 A | | 1/1972 | Gritzner et al. | 204/128 |
| 3,799,860 A | | 3/1974 | Gritzner et al. | 204/258 |
| 4,311,568 A | | 1/1982 | Balko | 204/128 |
| 4,767,511 A | * | 8/1988 | Aragon | 210/743 |
| 5,294,319 A | * | 3/1994 | Kaczur et al. | 204/290.03 |
| 5,385,650 A | * | 1/1995 | Howarth et al. | 205/619 |
| 5,411,641 A | | 5/1995 | Trainham, III et al. | 204/59 R |
| 5,770,035 A | | 6/1998 | Faita | 205/624 |
| 6,066,248 A | | 5/2000 | Lyke et al. | 205/620 |
| 6,203,675 B1 | * | 3/2001 | Zimmerman et al. | 204/252 |

FOREIGN PATENT DOCUMENTS

| | | |
|---|---|---|
| CA | 2250527 | 4/1999 |
| DE | 100 48 004 A1 | 4/2000 |
| GB | 1 365 093 | 8/1974 |

OTHER PUBLICATIONS

Abstracts, The Electrochemical Society, Inc. (1998) 193 meeting, May 3-8, No. 871.
De Nora S.p.A. Symposium (1998) May 4-6, pp. 191-203.
Picket, "Electrochemical Reactor Design", Elsevier Scientific Publ. Co., 232-233 (1979).
UHDE GmbH, "Chlorine and Hydrogen from HCl by Electrolysis", Hi530, 1000e (Mar. 1993).

* cited by examiner

*Primary Examiner*—Arun S. Phasge
(74) *Attorney, Agent, or Firm*—Morgan, Lewis & Bockius LLP

(57) ABSTRACT

Chlorine is produced by electrolysis of aqueous HCl, in a membrane electrolyzer, using cathodic mediators such as Fe(III) and/or Cu(II) chlorides and a non-catalysed 3-dimensional cathode, with the real surface area at least ten times higher than its projected area. The HCl electrolysis section is combined with an oxidizer for regeneration of the mediator, product water removal step and optional HCl recovery step. Under optimized conditions chlorine can be produced at very high current densities of 30 kA/m$^2$, without initiating undesired $H_2$ evolution reaction at the cathode.

21 Claims, 6 Drawing Sheets

MEDIATED HYDROHALIC ACID ELECTROLYSIS

FIELD OF THE INVENTION

This invention relates to the electrolysis of hydrogen halides, especially hydrogen chloride, by means of a novel mediated process, which provides both process intensification and energy savings.

BACKGROUND OF THE INVENTION

Hydrogen chloride is a reaction by-product of many chemical processes, which use chlorine gas. For example, in the manufacturing of polyurethane, the starting reactants are chlorine and carbon monoxide, which react to form phosgene ($COCl_2$). Phosgene subsequently is reacted with amine (R—NH2) to form isocyanate (RNCO) and 2 moles of HCl. Polyurethane is a polymerisation product of isocyanate. Isocyanate does not contain chlorine and yet chlorine is consumed in the synthesis of phosgene. This creates an opportunity for chlorine recovery from the by-product HCl, especially if the latter cannot be sold. Further, there is an increased pressure to curtail transportation of liquid chlorine, which forces isocyanate producers to build their plants in the vicinity of chloralkali plants and necessitating close coupling of both plant operations. Similar opportunities exist in manufacturing of polycarbonates, titanium dioxide, chlorobenzene, chloromethanes, certain fluoro compounds, phosphonates, and the like.

Recovery of chlorine from by-product HCl has been a subject of many developments. Those could be principally divided into two groups: (i) catalytic oxidation and, (ii) electrolysis. In the first group commercial processes exist under trade names "Kel-Chlor", "Shell-Chlor" or "MT-Chlor". All of those processes are based on the Deacon reaction:

$$4HCl+O_2+cat.\rightarrow 2Cl_2+2H_2O$$

The catalytic processes are regarded as complicated because they require extensive separation to achieve product purity. Furthermore, since those processes are operated at temperature of 250° C. or more and involve highly corrosive reactants, the materials of construction must be able to resist severe corrosion. Such materials could be expensive. A few catalytic oxidation plants have been built, however they were plagued with numerous operating problems.

The electrolysis route comprises an anodic oxidation of chloride anions to chlorine paired with a cathodic reduction reaction. The most obvious cathodic process is reduction of $H^+$ ions to $H_2$. The only commercialised technology, offered by Uhde GmbH (Germany) is based on such process scheme. According to a reference list in Uhde's 1993 brochure "Chlorine and hydrogen from hydrochloric acid by electrolysis" some 14 HCl electrolysis plants were built worldwide. Following recent technology improvements, the key performance parameters for the Uhde process are as follows:

| | |
|---|---|
| Operating current density: | 4-4.8 kA/m$^2$ |
| Cell voltage: | 1.92-2.06 V |
| Power consumption: | 1,500-1,600 kWh/t $Cl_2$ |

Uhde process employs cells consisting of bipolar graphite electrodes, separated by PVC cloth diaphragms, all connected in series to form an electrolyzer. 22% and 21% HCl is fed separately to the anode and cathode compartments respectively. Following the electrolysis, the depleted (about 17%) HCl is passed to HCl gas absorption section, where its strength is re-adjusted to suit the electrolysis specifications.

A number of improvements to HCl electrolysis have been proposed over years in patents and other publications. Those improvements primarily aimed at intensification of the process (higher c.d.) and/or lowering power consumption. For example, U.S. Pat. No. 4,311,568 to Balko describes a process for electrolysis of HCl, which uses a solid polymer electrolyte membrane with an anode bonded to one side of the membrane, and the cathode bonded to the other side of the membrane. Both anode and cathode contain $RuO_2$—$IrO_2$ electrocatalyst. In this process $H_2$ is still evolved at the cathode and the highest cited c.d. is 1,000 A/ft.$^2$ (i.e. 10.75 kA/m$^2$). The cell voltage data have only been disclosed for the 600 A/ft.$^2$ (6.45 kA/m$^2$) c.d. and with the optimised anode structure, it was about 1.8 V. That translates to power consumption of about 1360 kWh/t $Cl_2$, assuming 100% anodic current efficiency. Balko has demonstrated a feasibility of operation at elevated (compared to Uhde process) current densities but he has not eliminated the parasitic reaction of $O_2$ evolution at the anode. Traces of $O_2$ in chlorine may lead to accelerated degradation of carbon-based components in the cell. U.S. Pat. No. 5,411,641 to Trainham, III et al. discloses a novel concept of HCl electrolysis, in which anhydrous HCl is directly fed to the anode compartment of the cell, while dilute HCl environment is maintained in the cathode compartment. It is argued that the anode will be exposed to a much higher chemical activity of HCl, which will translate to a lower cell voltage and higher operating c.d. The cell itself can incorporate a solid polymer electrolyte membrane such as Nafion with the electrodes bonded to each of the two membrane faces. Such structure is also referred to as Membrane Electrode Assembly (or MEA). Based on the cited example the current densities not higher than 7.8 kA/m$^2$ were demonstrated and the cell voltages (and hence power consumption) were not much different than those described by Balko above. Still, Trainham, III concept appeared to have eliminated an HCl absorber from the overall HCl electrolysis plant scope. Finally, it also recognises that the process can be operated with oxygen reducing cathode to bring about further significant cell voltage reduction. However, no actual examples are given. On the other hand, U.S. Pat. No. 5,770,035 to Faita, is exclusively focused on HCl electrolysis with utilisation of the oxygen diffusion cathode. Thanks to the energetically more favourable cathodic reaction (i.e. electroreduction of $O_2$) significant reduction of cell voltage can be achieved. For example, at c.d. of 3 kA/m$^2$, the recorded cell voltage was about 1.2 V vs. 1.75 V in a reference experiment involving conventional $H_2$-evolving cathode. The power consumption at 1.2 V can be calculated at about 910 kWh/t $Cl_2$. While this new HCl electrolysis concept is quite attractive from the power consumption point of view, the operating c.d. is lower than that of a conventional Uhde process. Furthermore, gas diffusion cathodes are complicated in the design and not very reliable. Still, according to a paper by F. Federico (De Nora, S.p.A., Italy) presented at the De Nora Symposium (Venice, May 4-6, 1998) this process has been scaled-up to 2.5 m$^2$ electrolyzers, which have been installed and operated, on a technology demonstration basis, at Bayer production site in Leverkusen, Germany.

U.S. Pat. No. 6,066,248 to Lyke et al. discloses yet another variation of the HCl electrolysis process in which anode comprising an electrocatalyst and ionomer is either bonded to the membrane separator (Nafion type) or to the anode backing material. In all cases the catalyst layers (anode and cathode) had a thickness of 2 μm. Lyke et al. have demonstrated operation of their cell with the following cathode reactions (best results cited):

| Cathode Reaction | Max. Current Density (C.D.) ($kA/m^2$) | Cell Voltage (Volt) | Temp ° C. | Catholyte Pressure (psig) |
|---|---|---|---|---|
| $H_2$ evolution | 20 | 1.86 | 60-90 | atm. |
| $O_2$ reduction | 10 | 1.20 | 80 | 60 |
| Fe(III) reduction | 10 | 1.22 | 80 | atm. |

On the surface, regarding the process version with $O_2$ reduction as the cathode reaction, Lyke et al. has tripled the c.d. of the Faita patent. However, they have demonstrated it only in a very small (5 $cm^2$) laboratory cell for a brief period of time. It is obvious to those skilled in the art, that the scale-up of oxygen depolarised cathode is a formidable task—accordingly the De Nora technology (i.e. Faita patent) truly defines the present state of the art, as far as HCl electrolysis with oxygen diffusion cathode is concerned.

In their third electrolysis concept, where the cathode reaction is reduction of a multivalent metal chloride (e.g. Fe(III) chloride), Lyke et al. do not disclose it in the context of the overall process. However, in the earlier U.S. Pat. Nos. 2,468,766 and 2,666,024 Low discloses an HCl electrolysis process, in which Cu(II) or Fe(III) chloride is reduced at the cathode to Cu(I) or Fe(II) chloride, respectively. Given that the cathode process has now higher standard potential, e.g. +0.77 V for Fe(III)/Fe(II), than that of $H_2$-evolving cathode (0.0 V), a corresponding decrease in cell voltage can be expected. The reduced metal chloride can be subsequently re-oxidised in an external reactor by contacting the spent catholyte solution with oxygen or air. In Low's inventions the HCl electrolyzer is cylindrical, un-separated and contains a solid graphite anode (annulus) and a porous graphite and a hollow-core cathode in the center. Due to the cylindrical cell geometry, the cathodic c.d. is about 70% higher than anodic c.d. HCl electrolyte containing Cu(II) or Fe(II) chloride is first passed by the anode, where $Cl^-$ ions are oxidised to $Cl_2$ and then it is evacuated through the porous cathode to the oxidising section. A preference towards using Cu(II) chloride is stated and exemplified. The possibility of using a mixed Cu(II)—Fe(III)—HCl system is also mentioned without elaborating on potential benefits. In the Low's process concept, the electrolyte flow through the cell must be carefully optimised to: (i) allow disengagement of product Cl2, and (ii) to minimise back-diffusion of the reduced form of metal chloride (towards the anode). Likewise, the distance between the electrodes cannot be too close. Any portion of dissolved chlorine that comes into contact with the reduced metal chloride or the cathode constitutes a loss of c.e. In fact, under optimised conditions, Low has only achieved c.e.'s in the range of 81-85%. The highest cited cathodic c.d. was 509 A/sq. ft. (5.4 $kA/m^2$) but the corresponding anodic c.d. was only 3.2 $kA/m^2$. With a cell voltage of 2.69V and even allowing the upper limit of c.e. the calculated power consumption is 2,390 kWh/t $Cl_2$. This value is significantly higher than that in a conventional Uhde process, indicating that despite the favourable thermodynamics resulting from employing cathodic reaction with a higher potential, the compromises made in the electrolyzer design (to maximise c.e.) had resulted in the overall un-impressive technical performance.

The idea of using cationic additives to facilitate oxidation of Fe(II) chloride with oxygen has been previously disclosed in GB Patent 1,365,093 to Kovacs who found that addition of cupric or cuprous ions and/or ammonium ion promotes oxidation of ferrous chloride by oxygen.

The concept of employing reducible metal chlorides for the cathodic reaction in the electrolysis of HCl is known in U.S. Pat. Nos. 3,635,804 and 3,799,860 to Gritzner et al. who have employed a filter-press type cell, with solid graphite electrodes separated by plastic cloth diaphragm. An external oxidiser for re-oxidation of spent catholyte is also disclosed. The cell had separate anolyte and catholyte circuits. Catholyte consisted of about 1.5M $CuCl_2$ and 6M HCl. Spent catholyte had only a maximum 4.2% of original Cu(II) converted to Cu(I), with a significant decrease in c.e.—see example 34 in U.S. Pat. No. 3,799,860. Higher catholyte re-circulation rate kept c.e. high, however it also put a high hydraulic load on the oxidiser. Unfortunately, the highest c.d. employed by Gritzner et al. was only 1 $A/in^2$ (1.6 $kA/m^2$)—see examples and Claim 17 (in U.S. Pat. No. 3,799,860). Under condition of low catholyte (Cu(II)→Cu(I)) conversion, current efficiency in the low 90%'s and low cell voltage was achieved, as demonstrated in example 36 wherein the calculated power consumption at low c.d. of 1.6 $kA/m^2$ was about 930 kWh/t $Cl_2$. To put this value in context, the power consumption in the De Nora process, as per aforementioned paper by Federico is 900 kWh/t $Cl_2$ but at a much higher c.d. of 3 $kA/m^2$.

High surface area electrodes are known under the terms "3-dimensional electrodes" or "3D electrodes". The 3D electrodes are characterised by an electroactive area, which is significantly higher than their projected area. The real surface area of 3D electrode can be calculated for regular structures such as uniform particle beds, woven fabrics, and the like. For irregular materials the real surface can be determined by methods known in the art e.g. BET adsorption method or mercury intrusion porometry.

Unlike planar or 2D electrodes, the 3D electrodes are also characterised by the finite thickness of the electroactive zone, wherein in 2D electrodes the electroactive zone is simply the plane of the conductive material, which is exposed to the electrolyte—and thus this plane has zero thickness. A good review on 3D electrodes is contained in Chapter 3 (Three Dimensional Electrodes) in "Electrochemistry for A Cleaner Environment", edited by J. D. Genders and N. L. Weinberg, The Electrosynthesis Company Inc., E. Amherst, N.Y., 1992. On p. 52, the authors cite that the 3D electrodes have successfully been used for removal of low concentration of metal ions and organics from effluents prior to discharge. Subsequently, they teach that processing more concentrated solutions can introduce difficulties, such as plugging of the electrode porous structure with electrodeposited metal (page 80 and 86). In FIG. 3 (page 54) several typical configurations of cells, which employ 3D electrodes are shown. Apart from the electrode geometry, e.g. rectangular or cylindrical, one can distinguish two basic configurations: known as a "flow-by" configuration, in which electrolyte flow is normal to the current vector, and a "flow-through" configuration, in which the electrolyte flow is parallel to the current vector.

In summary, notwithstanding extensive development and certain progress made, there still is a need for an HCl electrolysis process, which offers both process intensification, i.e. high current density, and low power consumption.

SUMMARY OF THE INVENTION

The invention described herein provides an intensified, energy efficient process for the electrolysis of aqueous hydrohalic acid solutions to produce halogen at an anode in conjunction with an aqueous solution containing metal ions reducible at the cathode, the improvements comprising feeding the catholyte solution containing high concentration of reducible metal ions to a porous cathode structure having a high ratio of surface area to its projected area which enables a very high current density operation. The preferred embodiment of the invention employs an electrochemical cell having a solid polymer electrolyte membrane separating the anode and cathode, an electrocatalyst deposited on a porous electro-conductive substrate disposed adjacent to the membrane for the anode, and a porous graphite structure with no electrocatalyst adjacent next to the membrane for the cathode. The cathode reaction of the mediated process reduces metal ions from a higher valence or oxidation state.

Accordingly, the invention in one aspect provides a process for the production of a halogen gas by the electrolysis of an aqueous hydrohalic acid solution in an electrolytic cell, said cell comprising an electrocatalyst-containing anode; a cathode; an anolyte chamber; a catholyte chamber; a solid polymer electrolyte membrane separating said anolyte chamber from said chatholyte chamber;

said process comprising (a) feeding an aqueous hydrohalic acid feedstock to said anolyte chamber;

(b) feeding an aqueous catholyte feedstock to said catholyte chamber, said catholyte feedstock comprising a metal ion species in a first oxidation state operably reducible to a lower and second oxidation state at said cathode to produce a catholyte effluent containing said reduced metal ion species;

(c) operably producing said halogen gas at said anode within said anolyte chamber and a depleted hydrohalic acid effluent;

(d) collecting said halogen gas and said depleted hydrohalic acid effluent;

the improvement wherein said cathode comprises an electroconductive cathode comprising a portion having a surface area of at least ten times its projected area.

The cathode is preferably at least 0.5 millimeters thick and more preferably, has a thickness selected from the range 0.5 to 10 millimeters.

Preferably the cell operates at a current density of greater than 4 kA/m$^2$, preferably greater than 10 kA/m$^2$ and more preferably, at least, 11-30 10 kA/m$^2$.

Preferably, the portion of the cathode is operating at a current density of greater than 4 kA/m$^2$.

Preferably, the process as hereinabove defined further comprises the portion of the cathode comprises a material selected from the group consisting of carbon, a metal carbide, a metal nitride, a metal boride, a conductive metal oxide and hydrochloric acid stable metal alloy.

The oxidiser may be an oxygen-containing gas.

Preferably, the process comprises least a portion of the catholyte effluent recycled through an oxidiser and the metal ion species in the lower oxidation state is oxidised to the first oxidation state in the side stream prior to recycle back to the catholyte chamber and/or wherein the oxidiser uses oxygen-containing gas.

Preferably, spent catholyte containing lower valence state metal ions is oxidised in an external reactor using oxygen-containing gas. This contrasts with the known DeNora process which employs direct reduction of oxygen at catalysed gas-diffusion cathodes, which cathodes are expensive and difficult to manufacture.

The porous structure of high surface area may be termed as a three dimensional cathode (3D cathode), which may have a surface to projected area ratio greater than about 10 which, surprisingly, enables current densities greater than 4 kA/m$^2$ without evolution of hydrogen to be attained.

Preferably, the anode of use in the practise of the invention is a 2-dimensional anode having a surface area equal to the projected area or a 3-dimensional anode having a surface area greater than the projected area.

Preferably, the halogen is chlorine and the hydrohalic acid is hydrochloric acid.

A significant industrial application is for the production of chlorine by electrolysis of hydrogen chloride. The use of preferred operating conditions and preferred components, including a 3D cathode with a surface to projected area ratio of about 200, results in a power consumption of 650 kilowatt-hours per metric ton of chlorine (kWh/tonne $Cl_2$) at a current density of 4 kA/m$^2$. This is a considerable reduction as compared to about 900 kWh/tonne $Cl_2$ obtained at about 3 kA/m$^2$ by Faita using direct oxygen reduction. At 10 kA/m$^2$, the present invention shows a power consumption of about 860 kWh/tonne $Cl_2$ or less, which is still a further saving to power consumptions of 910 and 920 kWh/tonne $Cl_2$ obtained at 10 kA/m$^2$ by Lyke for direct oxygen reduction and for metal ion reduction, respectively. Furthermore, the 3D cathode with a 200 area ratio can be operated at current densities of up to about 30 kA/m$^2$ before hydrogen evolution occurs. Thus, this enables a very flexible operation for such purposes as increasing rates to make up short-falls in a production schedule. Further enhancements of the 3D cathode allows for lower power consumptions and/or a greater range of current densities.

The mediated process according to the invention may utilise a number of metal ions or combination of metal ions dissolved in a catholyte solution, but for better intensification of the process, an acidic HCl solution containing ferric and ferrous chlorides, with some added cupric chloride is preferred. The acidic cupric/ferric/ferrous chloride solution can be chosen with concentrations of the components that do not overly compromise power consumption and do not cause crystallisation of less soluble components, particularly ferrous or cuprous chlorides, in the cell or exit catholyte. The addition of cupric chloride and higher acidity are especially favourable for increasing the rate of ferrous ion oxidation using oxygen, which provides for reduced reactor sizes and overall volume of catholyte solution. The oxidation reactor may include activated carbon for increasing the rate of ferrous ion oxidation using oxygen. The process is especially intensified using acidic, cupric/ferric/ferrous chloride catholyte feed solution, since an excess of ferrous ion, which is not totally converted, is available in the oxidation reactor to facilitate nearly complete consumption of the oxygen. Nearly complete oxygen consumption provides for further advantage in reducing gaseous emissions of hydrogen halide from process steps that may be used to remove water and hydrogen halide from the catholyte in order to balance transfers of these components across solid polymer membranes, as well as water produced by the oxidation reaction.

The anolyte in the anolyte chamber, preferably, contains 5-500 ppm metal ions.

The catholyte may contact the cathode in either a "flow-through" mode or a "flow-by" mode as these terms are understood by those skilled in the art.

The mediated process according to the invention may include pressurised cell operation to provide for improved power consumption, reduced capital and processing costs in the product halogen treatment, and feeding of the catholyte solution directly to a pressurised oxidation reactor. Furthermore, the pressurised cell and catholyte oxidation step facilitates a preferred embodiment for energy conservation comprising flash evaporation to remove water and hydrohalic acid vapours from the catholyte solution.

Thus, the process may be beneficially operated when the electrolytic cell compartments are under a pressure greater than atmosphere.

Multiple stages of condensation for the removed vapours are included in a preferred mediated process of the invention to recover the hydrohalic acid for recycle in the process, particularly, together with condensed water, for recycle to the anolyte to, thus, balance transfers of these components across the membrane.

A portion of the water contained in the oxidised catholyte may be removed prior to the recycle to the catholyte chamber. A portion of the hydrogen halide contained in the oxidised catholyte effluent may be removed prior to recycle to the catholyte chamber. Such removals may be carried out by flash evaporation. The water and hydrogen halide removed from the oxidised catholyte effluent are, in whole or in part, added to the anolyte.

The process according to the invention as hereinabove defined may use a cell wherein the anode and/or the cathode is bound to the membrane.

The processes of the invention as hereinabove defined and designated as Mediated Hydrohalic Acid Electrolysis, are characterised by the use of a 3D cathode, which provides for the operation of the electrochemical cell at very high current densities and low power consumption. The mediated process disclosed herein further includes improved overall processes that provide for efficient use of raw materials and minimal effluent.

BRIEF DESCRIPTION OF THE DRAWINGS

In order that the invention may be better understood, preferred embodiments will now be described by way of example only, with reference to the accompanying drawings, wherein.

DETAILED DESCRIPTION OF PREFERRED EMBODIMENTS

Description of Electrochemical Cells

Figure 1:
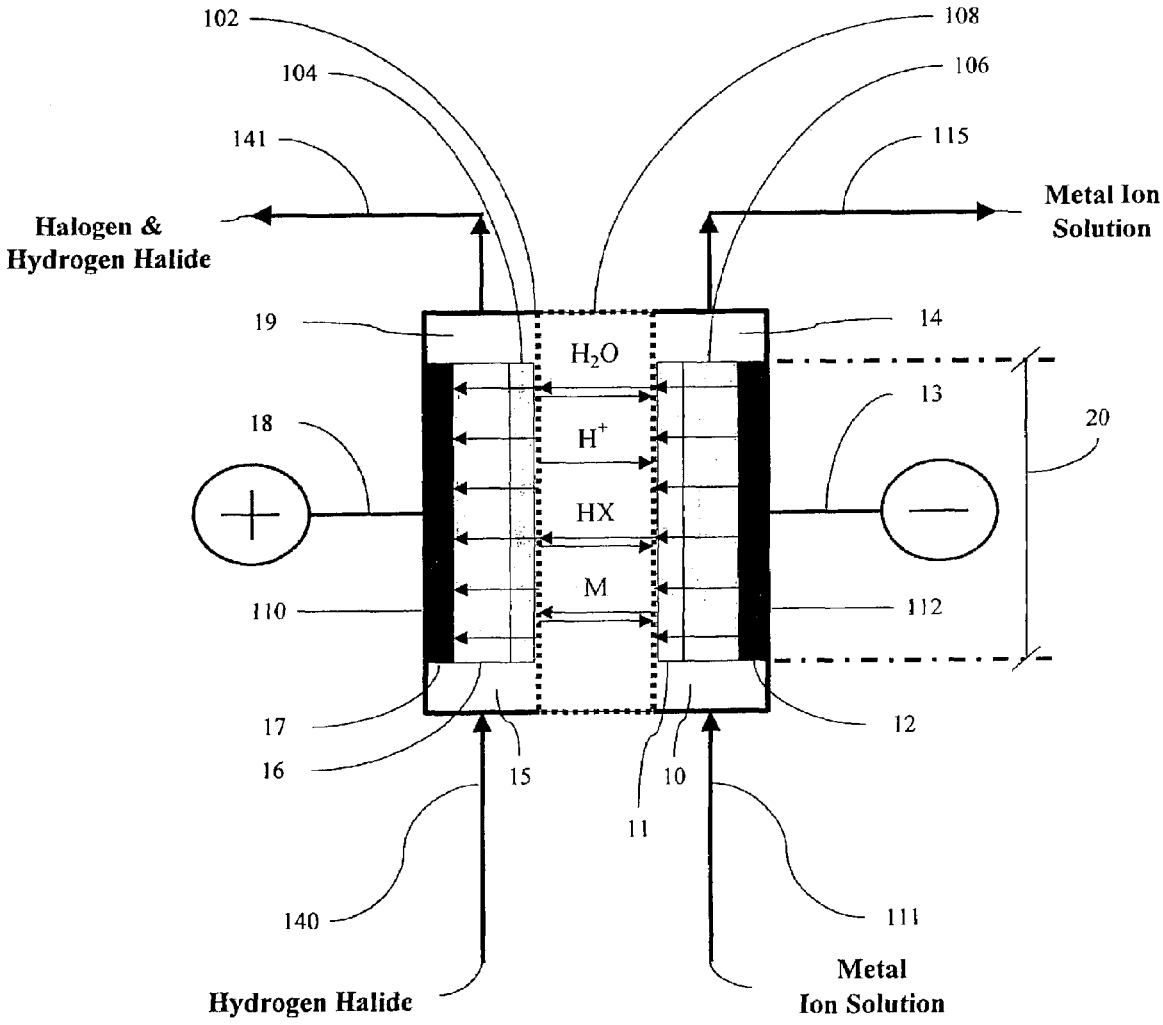
FIG. 1 is a diagrammatic cross-section of an operational electrochemical cell according to the invention.

With reference to FIG. 1, this shows an electrolytic cell 102 for the electrolysis of hydrogen halide having an anode 104, a cathode 106, separated by a membrane 108 into anolyte compartment 110 and catholyte compartment 112.

The catholyte compartment 112 comprises means for providing even distribution of an influent catholyte stream 111, means for collection of an effluent catholyte stream 115, and also contains elements effecting the cathodic reaction. Means for providing even distribution include flow distribution cavity 10 or channels for directing flow to an electrochemically active, flow distribution element 106 further described below as the three dimensional cathode (3D-cathode). The 3D-cathode, element 106, is shown in FIG. 1 as being sandwiched between an optional element 11 providing for protection of the membrane 108 and an element 12 providing for the distribution of electrons from a negative terminal connection 13. Catholyte passing through the 3D cathode is collected in cavity 14 or flow collection channels. In FIG. 1, parallel arrows crossing the 3D cathode 106 and the optional membrane protection element 11 indicate the net directional vector for current through the catholyte.

The anolyte compartment 110 comprises means for providing even distribution of an influent anolyte stream 140, means for collection of an effluent anolyte stream 141, and also contains elements effecting the anodic reaction. Means for providing even distributions include flow distribution cavities 15 or channels for directing flow to an optional flow distribution element 16 comprised of electrically conductive material. Flow distribution element 16 is shown in FIG. 1 as being sandwiched between an electrochemically active, anode element 104 and an element 17 for collection and transfer of electrons to the positive terminal 18. Anolyte passing the anode is collected in cavity 19 or flow collection channels. In FIG. 1, parallel arrows crossing the anode 104 and the optional flow distribution element 16 indicate the net directional vector for current through the anolyte.

In FIG. 1, there are shown dashed and dimensional lines 20 indicating one dimension of a two-dimensional area through which current flows through the cell with the net directional vector indicated by the arrows in the anolyte and catholyte chambers. The second dimension of the area projects into and out of the plane of the diagram. The two-dimensional area through which current flows through the cell is termed the projected active area or simply active area and is used in the art for the practical definition of current density.

The two-dimensional area described above for the active area is implied to be flat and rectangular but different polygonal or curvilinear flat areas such as hexagonal or circular, and different surfaces such as cylindrical are possible. In FIG. 1, the net directional vector of current is perpendicular or normal to the active area, and the net fluid flow direction through the anolyte and catholyte compartments is parallel to the surface of active area and perpendicular to the directional current vector. The fluid flows through the anolyte and catholyte compartments as indicated in FIG. 1 are termed transverse to the current vector and the cell is termed a flow-by cell. The flow-by type of cell is most convenient in equipment comprising many unit cells, particularly for cells employing hydraulically impervious membranes. Flow-through type cells have a net fluid direction that is generally parallel to the directional current vector as is common in many cell designs employing hydraulically permeable diaphragm separators replace. The invention is preferably of the flow-by type cell. Flow-through type cells may also utilise the invention.

The 3D cathode 106 may comprise one or more layers, each layer consisting of a porous structure constructed of electro-conductive material resistant to acidic metal ion solution, and enabling metal ion reduction. Porous structures include fibrous mats, reticulated foams, woven clothes, expanded or netted mesh, and beds of particles. Preferable porous structures are those which are more open, particularly to transverse (or edgewise) flow such as fibrous mats, reticulated foam, or beds of particles. Such porous structures also have the desirable characteristic of exposing large amounts of solid surface area within the bulk volume of the structure to fluid flowing through the structure. If more than one layer is used, the layers may be of different structures and also of different material. The most preferred embodiment uses one layer of material for economy. However, depending upon commercially available thickness, one or more layers of the same structure and material may be required to achieve a total desired thickness. by the choice of the porous structure and by use of one or more layers of porous structures. The ratio of total area of solid surface area compared to the projected active area of the cell can be manipulated to a desired value, Electro-conductive materials include carbon, acid resistant metals or metal alloys, and carbides, nitrides, or borides of metals. A combination of different materials may be contemplated such as a mat comprising both carbon fibres and metal fibres. Carbon and particularly highly graphitized carbon is a preferred material for economy, high corrosion resistance, good conductivity, and suitable electrochemical activity.

The thickness of the 3D cathode may be slightly greater than the depth of effective electrochemical activity, which may be estimated by empirical correlation of test data. A much thicker 3D cathode may compromise flow distribution. A thinner 3D cathode will increase velocity and turbulence at the expense of reduced solid surface area and increased pressure drop. A practical minimum thickness for a transverse-flow 3D cathode would be about 0.5 millimeters. For a large cell incorporating the high flow material for the 3D cathode, a series of alternating flow distribution and collection channels, spaced relatively far apart, reduces the pressure drop further enabling the use of a thin flow distribution element. This pattern of flow channels is known in the art as an interdigitated flowfield.

A preferred embodiment comprises a single 3D cathode layer of fibrous graphite material available in variable thickness from SpectraCorp of Lawrence, Mass., U.S.A. as the product Spectracarb 2050-HF45 and herein referred to as hi-flow material. The hi-flow material consists of a mixture of carbon fibres and a carbonaceous resin binder formed into thin sheets and heated in a non-oxidising atmosphere resulting in a highly graphitized structure. The structure was examined using Scanning Electron Microscopy (SEM). The fibres most generally lie parallel to the surfaces of the sheet but are randomly oriented in a planar area. The graphitized binder material is dispersed through the fibrous mass appearing as small nodules, or small patches of film, encompassing or adhering to several fibres. The material has the useful characteristic of being compressible to approximately 30% less than the rest thickness; further compression can result in structural failure and loss of compressibility. The structure is very open to both transverse (or edgewise) flow and face-to-face flow.

Other forms of the 3D cathode may incorporate an electrocatalyst to enhance the cathodic reaction. The preferred embodiment seeks to avoid the increased cost of such forms of the 3D cathode.

Depending upon the propensity of a porous structure to inflict damage of the membrane, a protective layer of different material and structure may be installed immediate to the membrane in the cathode chamber. The protective layer would be a porous structure that is preferably very thin and more open to normal (or face to face) flow so as to provide minimal hindrance to transfers to and from the membrane. Suitable porous structures having membrane protective characteristics but with more open face-to-face porosity include woven cloth and expanded mesh. The material of the protective layer may be conductive or non-conductive. Non-conductive materials for the protective layer include those synthetic polymers and ceramics having resistance to acidic metal ion solution. A preferable material is carbon which is available in clothes woven of spun fibre yarn and which also has desirable long term dimensional stability. Cloth of woven carbon fibres are available from Zoltek Corporation of St. Louis, Mo., U.S.A. as the product ®PANEX 30 PWB03 (graphitized spun yarn carbon fabric).

The membrane 108 may be any material allowing the transport of hydrogen ions $H^+$, is otherwise mostly impermeable to transfers of other chemical species, and is sufficiently physically and chemically stable for the purposes of usefully conducting the process over practical periods of time. Commercially available materials include those known in the art as solid polymer electrolytes formed into thin sheets. A solid polymer electrolyte can be, for example, a fluorinated polymer with pendant sulfonic acid groups. A solid polymer membrane may also be manufactured to include reinforcing fibres for additional resistance against physical damage such as tearing. Amongst several suppliers of solid polymer electrolyte membranes, E. I. du Pont de Nemours and Company of Wilmington, Del., U.S.A. is well recognised in the patent literature for their NAFION® products. Preferred solid polymer membranes useful for the process, include the NAFION® products designated N102, N105, N115 and N117 and any of their reinforced counterparts. Commercially available solid polymer membranes most typically provide for efficient transfer of hydrogen ions and are mostly impervious to transfers of other chemical species, but water is absorbed into such membranes by diffusion and is involved in the transfer of ions by attraction and the formation of hydration shells. Subsequently there are transfers of water through the solid polymer membrane. There are also limited transfers of other species across the membrane. In FIG. 1, the membrane 108 is shown exaggerated in thickness with respect to other components of the cell. Membrane transfers are indicated of the species, which are of importance to an overall process, including hydrogen ion $H^+$, water $H_2O$, hydrogen halide HX, and metal M.

The anode 104 may be of any form and material known to workers skilled in the art. However, for effective oxidation of halides to halogen, more specifically for oxidation of chloride to chlorine gas, the anode is constructed using electro-catalytic materials having high chemical stability in halide environments and a high propensity towards the oxidation reaction. Such electro-catalytic materials include oxides of ruthenium and iridium and mixtures of these materials together with additives enhancing desirable characteristics. Many other electro-catalysts are described in prior art. For economy, expensive electro-catalytic material is typically disposed onto less expensive conductive substrates such as titanium or carbon, the latter having better resistance to a hydrohalic environment. Forms of the anode include fibres of electro-catalytic material, or electro-catalyst disposed on wire or expanded mesh of titanium or other metals, metal alloys, or metal carbides. An anode consisting of electro-catalytic material disposed directly on one side of a solid polymer membrane by various means known in the art may be of utility as an embodiment of the present invention but adds cost and complexity. Such a combination of anode and membrane is commonly known as a membrane-electrode-assembly or MEA although the more common examples include an electro-catalytic material disposed directly on the second side of the membrane as the cathode. The anode electro-catalyst most utilised in the halide oxidation reaction is found to be at the face of the anode structure next to the membrane. The continual replenishment of chloride to these most active sites is facilitated by using a porous substrate structure that is preferably very thin and more open to normal (or face to face) flow so as to provide minimal hindrance to transfers to and from the anode face against the membrane. In the present invention we do not find it necessary to use electro-catalyst with an ionomer binder that adds cost and the ionomer may interfere with transfers of the halide and halogen species. In one embodiment of the present invention, the anode comprises an electrochemically active material applied to a cloth of woven carbon fibres available from Zoltek Corporation of St. Louis, Mo., U.S.A. as the product ®PANEX 30 PWB03 (graphitized spun yarn carbon fabric). Ruthenium oxide is applied to the carbon cloth by dipping the cloth into a solution containing soluble ruthenium compound such as ruthenium chloride, drying, and baking in an oxygen containing atmosphere at temperatures sufficient to convert the ruthenium compound to ruthenium oxide ($RuO_2$). The ruthenium oxide forms a thin coat approximately one micron thick on the carbon fibres. Subject to limitations of practical methodology, preferably a minimum thickness of electro-catalyst is applied while maintaining a coherent coating.

In the anolyte chamber 110 shown in FIG. 1, the flow distribution element 16 is preferably the same hi-flow material previously described for the preferred embodiment of the 3D cathode (fibrous graphite material from SpectraCorp of Lawrence, Mass., U.S.A. as the product Spectracarb 2050-HF45). The material provides for a very uniform distribution of anolyte flow in the anolyte chamber that is useful to ensuring replenishment of halide to the anode. The thickness of this flow distribution element is as thin as possible for inducing higher velocities and turbulence that are favourable towards transfers of halide and halogen at the anode, but practical pressure drop probably limits the minimum thickness to about 0.5 millimeters. Alternate porous structures may be contemplated.

Uniform flow distribution in the anolyte chamber may be accomplished using multiple flow distribution channels in a variety of patterns and the flow distribution element 16 might be eliminated. A large number of closely spaced distribution channels is required to be effective in the replenishment of halide to the anode. The complexity and added cost of such an embodiment are not necessary. However, for a large cell incorporating the high flow material a series of alternating flow distribution and collection channels, spaced relatively far apart, reduces the pressure drop further enabling the use of a thin flow distribution element. This pattern of flow channels is known in the art as an interdigitated flowfield.

Element 12 of the catholyte chamber and element 17 of the anolyte chamber providing for uniform current through the cell may form the catholyte and anolyte chambers and incorporate the flow distribution and collection channels. In one embodiment of the invention, both elements 12 and 17 are constructed of graphite plates. The plates can also be made of those metals and electrically conductive composite materials that provide for resistance to the chemical environment. Metals include titanium and its alloys, and the acid resistant high nickel content alloys. Electro-conductive composite materials include synthetic graphite with added polymer such as polyvinylidene fluoride (PVDF). The plates are sealed and electrically isolated at the membrane. With appropriate methods including use of a chemically inert, non-conductive grease applied to the sealing surfaces, the membrane can form the seal and provide electrical isolation between the plates. Other sealing and isolation methods include the use of gaskets or o-rings and various combinations. The plates compress the sandwich of elements in the anolyte and catholyte chambers to enable good electrical contact between electro-conductive elements in the electrolyte chambers.

The combination of preferred materials for the elements 106, 11, 104, and 16 also provides for uniform support of the membrane on both sides. This facilitates practical operation of the cell at high pressures, particularly with large differences in pressures between the anolyte and catholyte sides of the membrane. Membranes are typically of limited strength and without a very uniform support, large differential pressures that may be intentionally or accidentally applied will cause tearing or rupture.

Many cells 102 may be placed together in an assembly known in the art as an electrolyzer. In one embodiment the plates forming the anolyte and catholyte chambers are double sided, each plate forming two respective electrolyte chambers, incorporate larger flow channels connecting individual cells to common electrolyte inlet ports and outlet ports, and are electrically connected in parallel forming a monopolar electrolyzer. In a preferred embodiment, the plates each form an anolyte chamber on one side and a catholyte chamber on the other side thus electrically connecting cells in series, and form a bipolar electrolyzer. In a bipolar electrolyzer the plates incorporate electrolyte flow channels to and from individual cells connecting with manifolds formed in the plates or connecting to external manifolds. The electrolyzer assembly includes means for compressing the cell components. For pressurized operation the electrolyzer can be enclosed in a vessel that is more readily designed for pressure codes and low accidental emission, that can be pressurized with inert gas to reduce sealing and other design requirements of the electrolyzer components, and that may incorporate the compression means for the electrolyzer components. Other forms of large-scale cell assemblies incorporating alternate materials, alternate element configurations, and additional details are apparent to workers skilled in the art.

Reactions:

At the anode 104 is effected the oxidation of a hydrohalide, generally denoted as HX, to produce halogen $X_2$ according to the half-cell electrochemical reaction $$\text{Anode reaction: } X^- \square \tfrac{1}{2}X_2 + e^- \quad (1)$$

At the cathode 106 is effected the reduction of a metal ion M from a higher valence $M^{n+1}$ to a lower valence $M^n$. The electrochemical half-cell reaction at the cathode can be expressed as $$\text{Cathode reaction: } M^{n+1} + e^- \square M^n \quad (2)$$

The overall reaction of the cell with the above half-cell reactions can then be expressed as $$\text{Overall: } X^- + M^{n+1} \square \tfrac{1}{2}X_2 + M^n \quad (3)$$

Since the generation of chlorine from hydrogen chloride is of the most industrial significance, we restrict further illustration of the invention to the anodic oxidation of hydrogen chloride. Different compounds of metals may be considered but metal halides are useful in the invention since even very small transfers across the membrane result in contamination that may be undesirable. Metal chlorides, the preferred compounds in the process for production of chlorine from hydrogen chloride, are soluble in aqueous solutions to significant concentrations useful in the invention for reducing flowrates through the catholyte chamber.

Transfer of hydrogen ions passing through the solid polymer electrolyte or membrane primarily effects charge transfer from anode to cathode. The stoichiometry of the cathode reaction can be expressed as $$MCl_{n+1}+H^{+}+e^{-}\square MCl_{n}+HCl \quad (4)$$

The higher valence metal chloride can be regenerated using oxygen to oxidise the lower valance metal chloride according to the reaction $$2MCl_{n}+\tfrac{1}{2}O_{2}+2HCl\square 2MCl_{n+1}+H_{2}O \quad (5)$$

The cell reactions and the metal ion oxidation reaction using oxygen are employed in the overall process of the invention resulting in the stoichiometry $$2HCl+\tfrac{1}{2}O_{2}\square Cl_{2}+H_{2}O \quad (6)$$

Description of Mediated Process

Figure 2:
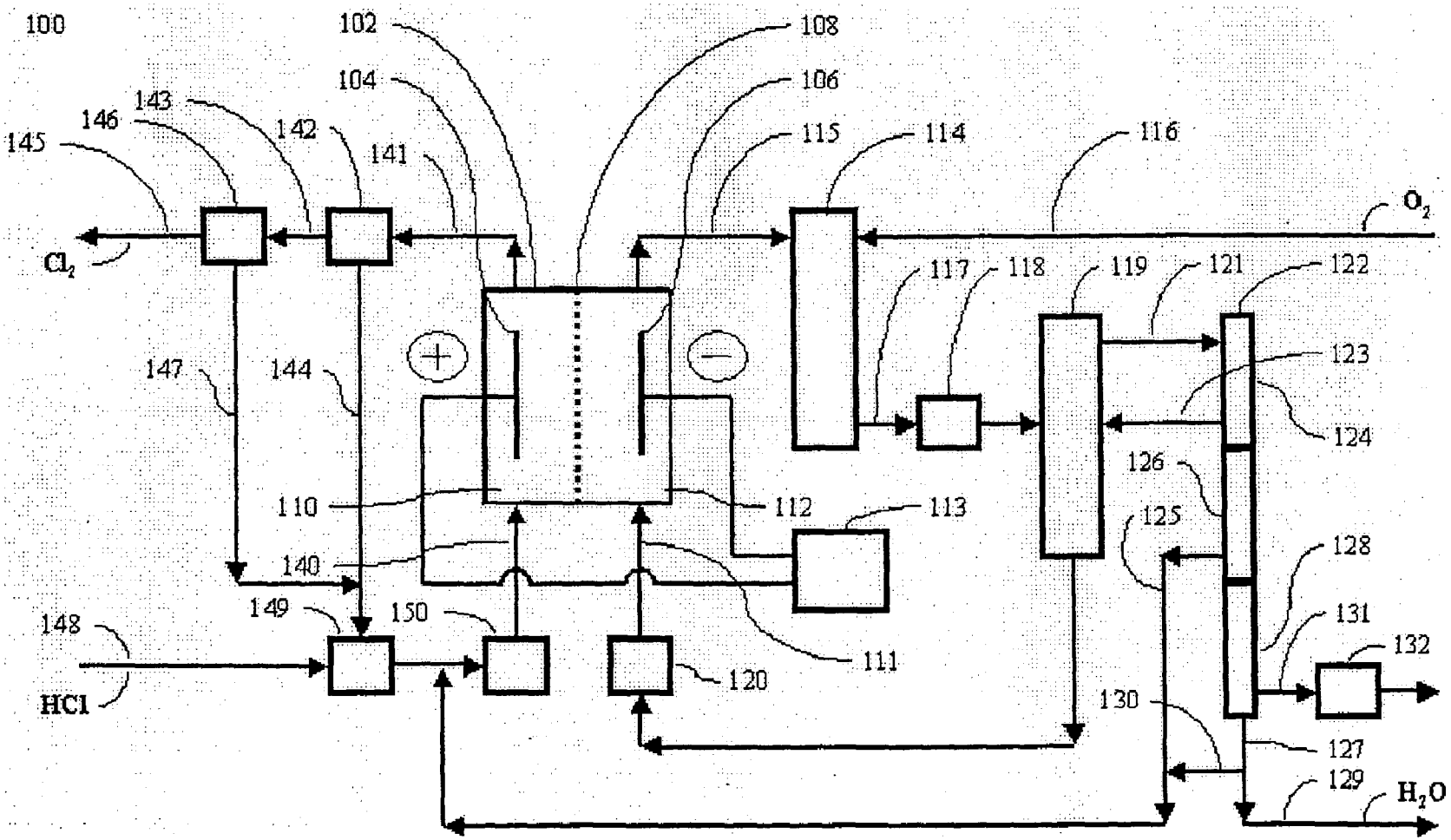
FIG. 2 is a diagrammatic layout of an aqueous hydrochloric acid electrolysis process with a recycle re-oxidation and water removal side stream, according to the invention.

With reference to FIG. 2, this shows generally as 100 an electrolytic cell 102 for the electrolysis HCl having an anode 104, a cathode 106, separated by a solid polymer membrane 108 into anolyte compartment 110 and catholyte compartment 112. The anode and cathode are electrically connected to power supply 113 for application of direct current. The cell effluent catholyte stream 115, containing reduced metal ion, e.g. $Fe^{2+}$, passes to an external oxidation reactor (or oxidiser) 114 for generating higher valency metal ion, e.g. $Fe^{3+}$, using an oxygen containing gas stream 116. Solution 117 from oxidiser 114 is passed to a flash evaporator 119 whereby partial water removal is effected. The aqueous outflow of the evaporator 119 is then cycled back as the feed catholyte stream 111 to catholyte compartment 112. A catholyte heat exchanger 120 provides for temperature adjustment.

Effluent anolyte 141 passes to a separation step 142 yielding a chlorine gas stream 143 and a effluent anolyte solution stream 144. Effluent anolyte solution is recycled through an HCl enrichment step 149 prior to recycle back to anolyte compartment 110.

Electrolytic cell 102 and oxidiser 114 are preferably pressurised to 5 bars.

The chlorine gas stream 143 is passed through a cooling step 146 to remove water vapours as condensate stream 147 returned to the anolyte solution. The cooled chlorine gas stream 145 may be used directly but more commonly is first dried, typically by contact with concentrated sulphuric acid, allowing for the use of carbon steel piping and equipment. By operating at higher pressures, the capacity of the cooling and drying steps are reduced and the chlorine gas can be used directly or liquefied effectively without employing expensive gas compression equipment.

Oxidiser 114 is any reactor type or scheme of reactors promoting the efficient utilisation of oxygen. Embodiments include stirred reactors with gas-entraining agitation, packed bed columns with counter-current gas and liquid flows, and fixed bed reactors with co-current gas and liquid. A reactor system, which results in nearly complete consumption of oxygen, is desirable to avoid waste and cost. Furthermore, the more volatile components of the solution, hydrogen chloride and water, will also be constituents of the exit gas stream. A waste of oxygen can be avoided with recycle by means of additional compression equipment that may add considerable costs due to corrosive effects of the HCl vapours. If the residual gas is vented to atmosphere, hydrogen chloride emission must be reduced to within acceptable standards. The use of air will result in an exit gas stream that might contain little oxygen but the residual nitrogen gas stream would contain larger amounts of HCl and water. Although air is generally considered cheaper than pure oxygen, there are costs associated with dust removal, compression of larger gas volumes, increased size of process equipment for the larger gas volumes, and vent gas emission control. The overall rate of return on investment is not necessarily improved substantially using air instead of oxygen. Oxygen containing some inert gas such as the oxygen product gas of a pressure swing absorption process might also be used and would result in a small exit gas stream.

The preferred oxidant is oxygen. Other oxidants may be contemplated and many have greater reactivity than oxygen providing for greater oxidation rates. Examples of such oxidants that are most compatible include ozone, hydrogen peroxide, halogen, and some oxy-halogens such as chlorine dioxide. All of these oxidants are expensive compared to oxygen and generally impose some other difficulty. For instance, the oxidation reactor using hydrogen peroxide produces more water than the reaction using oxygen that dilutes the catholyte and increases removal effort in an essentially closed system. Similarly, halogen, generally the same as that produced by the electrolysis, represents a loss of product and produces hydrogen halide that must be removed in an essentially closed system. Ozone, hydrogen peroxide, and oxy-halogens are unstable and decomposition is typically catalysed by metal ions such that excess amounts of any of these chemicals is necessary. There may be some limited opportunity to use one of these oxidants in addition to the use of oxygen to reduce equipment size and/or to obtain lower concentrations of reduced metal ions in the catholyte feed solution. Such opportunities would be further considered if the chemical is readily available at low cost and if a closed system is not required. Generally, such oxidants may be useful and convenient for small-scale or laboratory purposes but unlikely to be seriously considered for a typical large-scale industrial plant.

Packed columns and fixed bed reactors with co-current flows of feed solution and oxygen gas is a convenient method for using carbon particles as a heterogeneous catalyst. Other reactor types include fluidised bed reactors.

As a preferred embodiment the oxidiser 114 is a fixed bed reactor containing carbon granules or extruded carbon pellets, having co-current gas and liquid flows. The reactor scheme is operated at high pressure and temperature to promote faster rates of oxidation. Preferably, the reactor scheme is operated at the same pressure and temperature of the electrochemical cell and a relatively pure oxygen gas is used.

Complete oxidisation of the reduced metal ion of the effluent catholyte is not necessary, particularly when an iron chloride catholyte solution is used. This reduces the size of the reactor system and the excess reduced metal ion facilitates nearly complete utilisation of oxygen.

A preferred embodiment employs a catholyte solution containing ferric and ferrous chlorides, hydrogen chloride, and cupric chloride components passing through a fixed bed reactor containing carbon. The cupric chloride acts as a homogeneous catalyst while the carbon acts as a heterogeneous catalyst and the combination of the two catalyst types further reduces the reactor size.

In the use of a reactor scheme utilising a heterogeneous catalyst, the regenerated catholyte solution is preferably passed through a filtration step 118 to remove solid catalyst particles caused by attrition.

The regenerated catholyte solution 117 exiting the oxidation step 114 is passed to an evaporator 119 to remove water as vapour to an exit gas stream 121 from the catholyte solution. Water otherwise accumulates in the catholyte as a result production of water in the oxidation step and as a result of transfer across the solid polymer membrane of the cell. The heat for the water evaporation is partly or completely supplied by heat produced in the oxidation step and by ohmic voltage losses of the electrochemical cell. A flash evaporator provides for the removal of water at lower temperatures. Thus the sensible heat of the inlet stream to the evaporator provides most or all of the latent heat of vaporisation. The flash evaporation step also provides for removal of excess heat whereby the cell temperature may be maintained constant.

Hydrogen chloride appears in the vapours from the evaporator and the amount of HCl depends upon the concentrations of components in the liquid and the temperature. To avoid loss of the HCl vapours, the evaporator exit gas stream 121 is passed to a condensation step 122 where HCl will be absorbed into condensed water. A preferred embodiment includes at least two partial condensation stages and a third condensation stage may be included providing for useful recycle streams recovering water and HCl. Some HCl may be recycled to the anolyte to balance any small transfer of HCl across the membrane from anolyte to catholyte. If the amount of HCl in the exit gas of the evaporator is greater than the amount of membrane HCl transfer, then the excess amount of HCl may be recycled to the catholyte to maintain a desirable concentration therein. Condensed water vapours equal to or slightly greater than the water transfer across the membrane from anolyte to catholyte may be recycled to the anolyte together with HCl recycled to the anolyte. Thus in the first partial condensation stage 124, excessive HCl and water vapours are condensed and recycled to the catholyte as stream 123. Additional HCl and water vapours are condensed in the second partial condensation stage 126 and recycled to the anolyte as stream 125. A third condensation stage condenses residual water vapours removed as stream 127. A portion of the final condensed stream may be added as stream 130 to the condensate stream 125 for additional water make-up to the anolyte. The remaining portion as stream 129 of the final condensate is representative of the water produced during the oxidation step and can be disposed with little, if any required effluent treatment. Also, the residual gas stream 131 to a vacuum generator 132 will contain little, if any HCl allowing for vacuum equipment constructed of less expensive materials and little, if any effluent gas treatment. The condensing temperatures in the partial condensation stages are adjusted to obtain the appropriate amounts of successive condensate streams providing for a balanced process with respect to water and HCl. Variations on the types and order of equipment items in the condensation and vacuum steps are apparent to those skilled in the art.

The aqueous outflow of the evaporator 119 is cycled back as the feed catholyte stream 111 to catholyte compartment 112. A catholyte heat exchanger 120 provides for temperature adjustment.

The anolyte system for the mediated process can use an anhydrous hydrogen halide gas stream or an aqueous hydrogen halide solution as the enrichment stream feed 148. The preferred embodiment incorporates the use of anhydrous hydrogen chloride gas as the enrichment stream to maintain about 20% w/w to 36% HCl concentration in the anolyte feed stream 140 with the effluent anolyte solution concentration in the range 15% w/w to 22% w/w HCl. Lower HCl concentrations of the influent and effluent anolyte solutions can be employed at the expense of decreased anode life.

An anolyte heat exchanger 150 provides for adjustment to obtain desirable cell temperature.

A pure anhydrous HCl enrichment stream can be injected directly into the feed anolyte solution. Variations of the enrichment step can be employed for anhydrous HCl supply streams, which are not pure. Any small amounts of volatile impurities injected into the anolyte feed stream will pass through the cell and contaminate the chlorine gas product. When the contamination is undesirable or if the amount of volatile components might cause poor distribution of the anolyte solution, a gas-liquid separator downstream of the injection point can be incorporated for substantial removal of the volatile components then passed to separate recovery or effluent treatment systems. The more conventional enrichment step would pass a side-stream of the effluent anolyte solution to an absorber where the volatile components are discharged in a tail gas stream while the enriched side-stream is then mixed into the feed anolyte stream. Additional purification steps of the anhydrous HCl gas and of the enriched side-stream solution may also be incorporated.

For reduced power consumption, preferred operating temperatures of the cell are about 60° C. to about 120° C. The higher temperatures give the lower power consumptions and facilitate water removal from the regenerated catholyte solution. Operating the cell at higher pressures facilitates higher temperature operation and provides for some further improvement of the cell voltage. The maximum operating temperature is subject to the limitations of the materials employed. Improvements in solid polymer electrolyte membranes or membranes of alternate materials not yet available may allow for the consideration of temperatures greater than 120° C.

Embodiments of the invention include optional integration of catholyte metal ion oxidation and/or anolyte enrichment into the electrochemical cell.

Metal ion reduction at the cathode and simultaneous oxidation of reduced metal ions by injection of oxygen with the catholyte feed stream or directly into the catholyte chamber has been described in the prior art. The latter injection was described particularly for the use of copper chloride catholyte solution, which was suggested to be a facilitator for cathodic reduction of oxygen. In the case of a single cell, injection of oxygen containing gas, preferably pure oxygen, with the feed catholyte stream may cause poor flow distribution within the cathode structure. A better distribution may be ensured by use of separate solution feed and gas feed distribution channels. The gas feed channels may further incorporate gas diffuser elements such as a series of small holes, sintered glass or metal, or the like. In the case of a practical industrial electrolyzer having more three or more cells, simple injection of the gas with the catholyte feed solution will most likely result in a non-uniform distribution of gas and liquid between the cells. Separate manifolds and flow distribution channels for gas and solution would be preferred. The advantage of reduced equipment through possible elimination of an external oxidiser is offset by the added complexity of the electrolyzer design and operation. Also the injection of oxygen by different means into the catholyte chamber may only be effective for use with a copper chloride solution wherein the oxidation of cuprous ions may be fast enough to allow for the use of small cathode chamber volumes apparent for the invention. Iron chloride and even mixed copper and iron chloride solutions, which have slower rates of oxidation, are less likely to be effective.

Similarly, hydrogen halide containing gas, hydrogen chloride for example may be injected with the feed anolyte solution or may be injected into the anolyte chambers providing enrichment of the anolyte solution. Hydrogen chloride will be absorbed quickly and completely into solution of appropriate flow and concentration providing for in-situ replenishment of chloride ions to the anode. A gas comprising only hydrogen chloride and water vapours up to saturation conditions would be preferred; otherwise other gaseous components of limited solubility would interfere with flow distribution and contaminate the chlorine gas product.

Embodiments may apply the 3D cathode and catholyte treatment steps of the invention in conjunction with other anodic half-cell reactions or combined electrochemical reactions with in-situ chemical reactions in the anolyte chamber. Those chemical reactions, which may be effected in the anolyte chamber at high current densities, are of particular interest and utility. A particular example of the latter is the in-situ production of carbonyl halides, phosgene ($COCl_2$) for example wherein a gas containing carbon monoxide (CO) is injected into the anolyte chamber to react with chlorine discharged by the anode from hydrogen chloride. A gas containing only CO, perhaps with hydrogen halide and water up to saturation conditions, is preferred, otherwise volatile gaseous components will interfere with flow distribution and/or contaminate the gaseous product.

The described process describes anolyte and catholyte circulation systems, which provides for greatest utility of raw materials for most industrial applications. There are circumstances where partial or no circulation is necessary. An aqueous HCl stream may be available that can be passed through the cell to produce chlorine gas, and the effluent HCl solution might be disposed of or be usefully employed elsewhere. Similarly, an available solution containing reducible metal ions may be passed through the catholyte compartment and the catholyte effluent disposed of or be usefully employed elsewhere. Examples of such catholyte systems may include metallurgical processes such as the production of titanium oxide ($TiO_2$) by the chlorine process, which produces a side stream of metal chlorides, especially ferric chlorides that are mostly disposed of but could first be passed through the cathode of the invention. If the quantity of such a stream does not satisfy the cell requirements, then the stream could be a feed stream to a catholyte circulation system with a purge stream to reduce oxidisation requirements and to provide partial or total balance of water in the system.

The process of the invention may be utilised in a standalone plant having raw materials, essentially hydrogen halide and perhaps oxygen that can be otherwise obtained on-site, transported to the plant location and having product halogen transported to users. Greater economy and other benefits in management and transport of chemicals is obtained by incorporating the process of the invention into plant complexes having process units using halogen and producing hydrogen halide, or having process units that separately use halogen and produce hydrogen halide, or combinations. The plant complex may also have process units producing solutions containing reducible metal ions for use in the catholyte system as just mentioned above. Common examples include plants for isocyanate production and plants combining ethylene dichloride (EDC) and vinyl chloride monomer (VCM) production units where by-product HCl would be converted by the process of the invention to chloride for recycle to the chlorination systems. Many variations involving integration of different forms of the invention, including alternate reactions in the anolyte compartment, with other process units can be contemplated.

Catholyte Solutions Containing Reducible Metal Ion

Many reducible metal ions may be considered such as chromium (III), iron(III), cobalt(III), copper(II), silver(II), cerium(IV), and gold(III). Other reducible species including acid-stable metal complexes, such as ferricyanide $K_3Fe(CN)_6$ might also be considered. The practical choices are iron and copper because of such factors as availability, cost, solubility, and toxicity. The standard reduction potentials for $Fe^{3+}/Fe^{2+}$ and $Cu^{2+}/Cu^{+}$ are listed in reference literature as 0.77 volts and 0.16 volts respectively; coupled with a standard reduction potential for $Cl_2/Cl^-$ of 1.36, the respective standard cell potentials are about 0.6 and 1.2 volts. However, metal ions are known to form complexes with other ions and species in aqueous solutions. Subsequently several half-cell reactions involving various complexes of the higher and lower valence metal ions are known to occur. Chloride complexes with copper ions are particularly significant towards a resulting standard reduction potential for copper in chloride medium of about 0.5 volts as reported by Benari et al (Max D. Benari & G. T. Hefter; "Electrochemical Characteristics of the Copper(II)/Copper(I) Redox Couple in Dimethyl Sulfoxide Solutions"; Aust. J. Chem., 1990, 43, 1791-1801). The standard cell potential using copper chloride is then about 0.86 volts. Determination of the half-cell potentials at actual operating conditions of temperature, pressure, and concentrations is complicated. We have measured comparable cell voltages using high concentrations of copper and iron chlorides. However, a mixture of cupric and cuprous ions used in the feed catholyte solution shows a cell voltage penalty compared to a catholyte solution containing a mixture of ferrous and ferric ions.

We have found a benefit towards long term stability of anode substrate material, specifically carbon materials, when using catholyte solutions containing iron chloride. A constant low level contamination by iron of anolyte solution is observed. Copper is known to form complexes with chloride more readily than iron and the reduced mobility of these complexes reduces the extent of copper transfers across the membrane.

We also have found that cuprous chloride is less soluble than ferrous chloride in the respective catholyte solutions. A higher concentration of hydrogen chloride in the solutions further reduces the solubilities. To avoid crystallisation of reduced metal chloride in the catholyte chamber, a higher flowrate of copper chloride solution is necessary compared to flowrates of iron chloride solution.

As a result of the above findings concerning benefits for cell operation, a preferred embodiment of the invention uses a catholyte solution that contains mostly iron chloride.

When the reducible metal ion of the catholyte solution is regenerated using oxygen, some presence of hydrogen chloride is, most preferably, present to prevent the formation of insoluble metal oxides. Higher concentrations of hydrogen chloride in the catholyte solution also accelerate the oxidation of reduced metal ions using oxygen. In chloride media, Kovacs (Great Britain Patent 1365093, filed Jul. 14, 1971) claimed beneficial ferrous oxidation rates using dissolved promoter cations consisting of ammonium, chromium, cobalt, copper, manganese, nickel, zinc, or mixtures thereof. Kovacs preferred a dual combination of ammonium ions plus one of the metal ions, particularly copper and cupric ions. The process conditions included elevated temperatures (120° C. to 500° C.) and super-atmospheric pressures (example of 100 psig), but HCl concentration was preferably low and even removed by adding finely divided iron oxide particles in excess of the amount to react with and remove HCl. However, we have found the addition of cupric chloride to solutions containing ferric and ferrous chlorides still accelerates the ferrous ion oxidation rate using oxygen even with significant concentrations of HCl. Thus as a dissolved constituent of the solution, cupric chloride acts as a homogeneous catalyst.

Catholyte solutions containing mixtures of reducible metal ions have been proposed for the electrochemical process in the prior art. Our measurements using catholyte solutions containing mixtures of iron and copper chlorides find the cell voltages to be essentially equivalent when cupric chloride is partially substituted for ferric chloride. The total amount of reducible metal ions in the catholyte feed stream is the sum of the ferric and cupric ions. A sufficiently high substitution of cupric chloride for ferric chloride will necessarily result in the appearance of cuprous ions in the catholyte effluent depending upon the amount of reducible metal ions required for the current applied to the cell. We seek to minimise the possibility of crystallising cuprous chloride solids in the catholyte chamber by limiting the substitution of cupric chloride for ferric chloride in the feed catholyte solution to the extent that no appreciable concentration of cuprous ions will be found in the catholyte effluent. A first estimate of the allowable cupric chloride concentration $C_C$ is obtained as a fractional portion of the total reducible ion concentration $C_T$ by subtracting the fractional conversion $X_T$ of total reducible metal ions from 1, hence $C_C/C_T=1-X_T$. For example, for a fractional conversion of 0.5 (50%), the estimated maximum cupric chloride concentration resulting in no cuprous ions in the catholyte effluent is about 1−0.5=0.5 (one-half) the total concentration of reducible metal ions. For a 1.8 mole per liter (molar, M) concentration of total reducible metal ions in the feed catholyte, the maximum cupric concentration should be about 0.9 M $CuCl_2$. Although some further substitution of cupric chloride for ferric chloride would be possible without causing the formation of crystals in the catholyte chamber, this formula provides for a definition of a practical boundary of concentrations for the mixed metal ions with respect to problems of possible blockage.

High hydrogen chloride concentrations are beneficial for accelerated rates of ferrous ion oxidation using oxygen but limit the solubility of the reduced metal chlorides and increase the amount of HCl vapours generated in the water removal step.

Thus, the preferred total concentration of all iron and copper species of the feed catholyte solution is in the range of about 2 to 3 moles per liter, while the preferred total reducible metal ion concentration of the feed catholyte solution is in the range of about 1.5 to 2 moles per liter. The preferred concentration of reduced metal ion concentration in the feed catholyte solution is in the range of about 0.5 to 1 moles per liter ferrous chloride. The preferred hydrogen chloride concentration in the feed catholyte solution is in the range of about 1 to 5 moles per liter.

EXAMPLES

Example 1

The use of a mediated electrochemical process for the electrolysis of hydrogen chloride in an aqueous solution was studied for power consumption (cell voltage) versus a range of applied current. A series of experiments were conducted using an electrochemical cell assembled as shown in FIG. 1. The projected active area of the cell was of dimensions 76 millimetres wide and 53 millimeters tall or 40 square centimetres. NAFION® N105 membrane was used in all experiments.

The anode in all experiments was ruthenium oxide applied to a cloth of woven carbon fibres. The thickness of the carbon cloth averaged 0.31 millimeters (mm). The ruthenium oxide forms a thin coat approximately one micron thick on the carbon fibres. An anode flow distribution layer of fibrous graphite material was used in all experiments. The flow distribution layer is the product Spectracarb 2050-HF45 previously described in detail and was a nominal thickness of 1.4 mm. The components used in the cathode chamber were changed for each of the experiments as listed below.

The components in the anode and cathode compartments were compressed between composite graphite-PVDF plates.

An aqueous solution of 20% w/w hydrogen chloride was fed to the anode chamber at a rate of 50 milliliters per minute (mL/min). Anhydrous hydrogen chloride gas was added to the pumped solution at a controlled flowrate determined as the rate of HCl consumed by the electrolytic current based on 100% efficiency of anodic chlorine production. All of the added anhydrous HCl gas dissolved completely in the acid solution before entering the cell.

The catholyte feed solution was prepared as an aqueous solution containing 1.8 M ferric chloride ($FeCl_3$), 0.7 M ferrous chloride ($FeCl_2$), and 3 M hydrogen chloride (HCl). The catholyte feed flowrate was adjusted for each current value for a 50% conversion of ferric ions to ferrous ions. However, the minimum stable flowrate for the equipment used was 22 mL/min so for current values less than 32 amperes (current density of 8 kA/$m^2$) the catholyte flowrate was maintained at this constant value. Subsequently, the conversion of ferric ions at current values less than 32 amperes is proportionally less than 50%.

The cell was operated at 70° C. The pressure of anolyte HCl solution and chlorine gas exiting the cell was controlled at 207 kilo-Pascal gauge (kPa g) (or 30 psig).

The pressure of catholyte solution exiting the cell was controlled at 172 kPa g (or 25 psig). Direct current was applied at increasing constant values in a stepwise progression, maintaining each current value usually 2.5 to 3 minutes to obtain a steady cell voltage reading. Current densities are plotted against the cell voltages in FIG. 1 (except experiment F, plotted in FIG. 5).

| Cathode Components | |
|---|---|
| Experiment A. | 1.4 mm thick fibrous graphite, Spectracarb 2050-HF45 |
| Experiment B. | Two layers polypropylene cloth, + One layer biplanar polypropylene mesh on Flat graphite-PVDF plate |
| Experiment C. | Two layers polypropylene cloth, + One layer biplanar polypropylene mesh + 2 layers thin fibrous graphite, carbon scrim, 0.04 mm |
| Experiment D. | One layer polypropylene cloth, + One layer biplanar polypropylene mesh + One layer graphitized spun yarn carbon fabric, ®PANEX 30 PWB03 |
| Experiment E. | One layer polypropylene cloth, + 1.1 mm thick fibrous graphite, Spectracarb 2050-HF45 |
| Experiment F. | 1.4 mm thick fibrous graphite, Spectracarb 2050-HF45 |

The total thickness of the compressed cathode components was constant at about 1.1 mm. The graphite components were compressed against the graphite plate.

Figure 3:
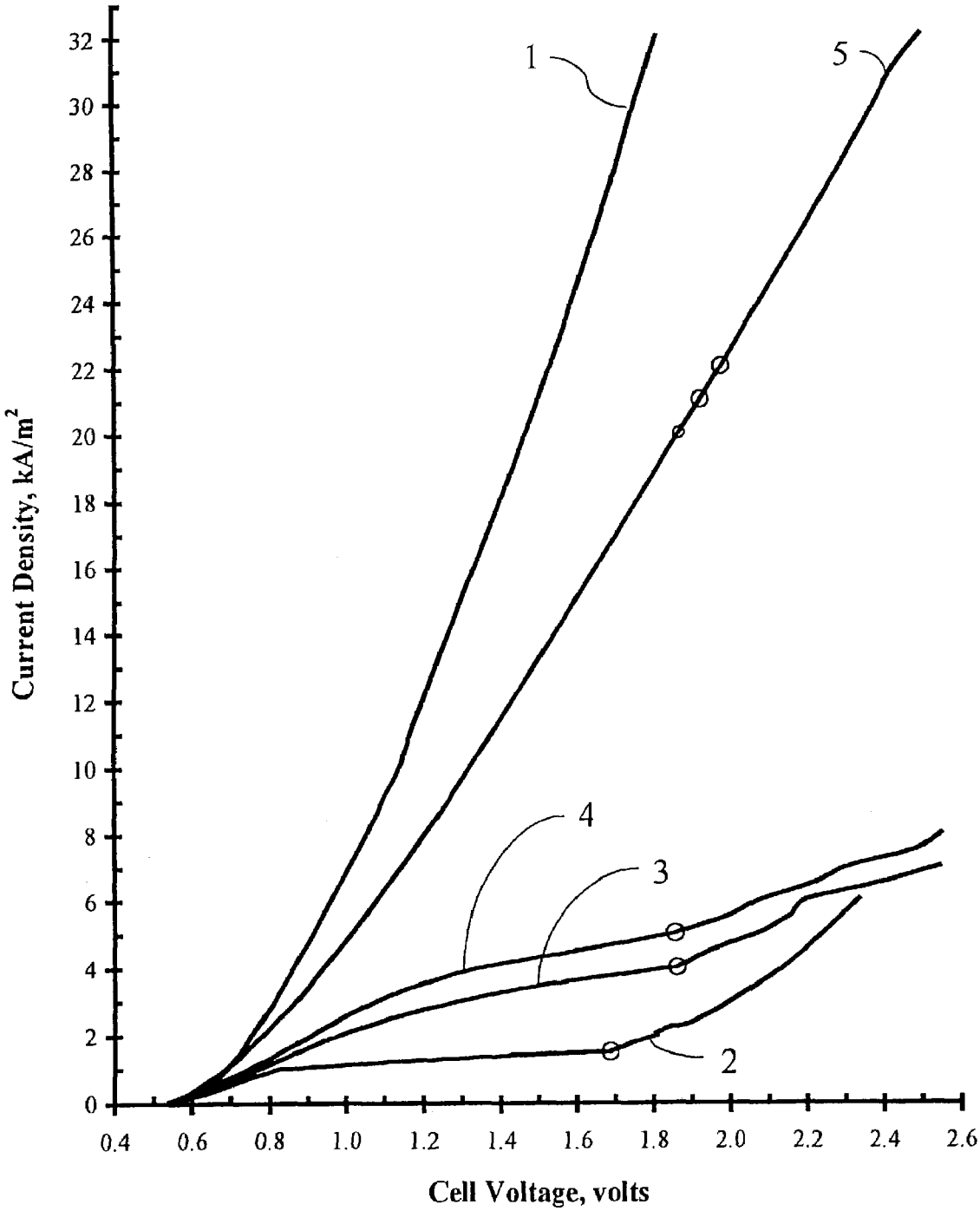
FIG. 3 is a graph of current densities plotted against cell voltages for several embodiments.

Experiment-A data is plotted as Curve 1 on FIG. 3. A current density of 32 kA/m2 is a very high value for an electrochemical process. The parameter most responsible for enabling this result was attributed to an electrochemically active surface area of the 3D cathode that was much greater than the flat projected area.

Experiment-B, Curve 2, FIG. 3. The only electrochemically active area for the cathode was the flat surface of the composite graphite-PVDF plate. There are three relatively distinct regions in the curve. Cell voltage increases most rapidly between current densities of 1 kA/m$^2$ and approximately 1.5 kA/m$^2$ and gas bubbles were observed in the exit catholyte stream above the latter current density. Such a pattern is well known to workers in electrochemistry as being representative of a change in the electrochemical reaction. In this case, the cathodic reaction is changing from ferric ion reduction to hydrogen ion reduction resulting in hydrogen gas evolution.

Experiment-C, Curve 3, FIG. 3. Carbon scrim is a non-woven fibrous graphite material. The carbon fibres of these thin layers are similar, in diameter and lengths, to those in the high flow material previously described and to those in carbon cloth. The cell voltage pattern has a similar nature to that obtained in Experiment-B but with less distinction of lower cell voltage regions. A reasonably distinct change in the pattern is observed at about 4 kA/m$^2$ and cathode gas evolution was observed as current density was increased above this value.

Experiment-D, Curve 4, FIG. 3. The cell voltage pattern has a similar nature to that obtained in Experiment-B but with less distinction of lower and upper cell voltage regions. A change in the pattern can be discerned at about 5 kA/m$^2$ and cathode gas evolution was observed as current density was increased above this value. The carbon cloth is a tighter structure compared to the other fibrous materials and is not the preferred structure for the 3D-cathode.

Experiment-E, Curve 5, FIG. 3. The cell voltage pattern with the 1.1 mm thick layer of high flow material is similar to that obtained in Experiment-A with a 1.4 mm thick layer of high flow material. The cell voltages are higher than those obtained for Experiment-A. Cathode gas evolution was observed in the current density range of 20-24 kA/m$^2$ but there is no distinction of cell voltage regions to provide a better definition.

Figure 5:
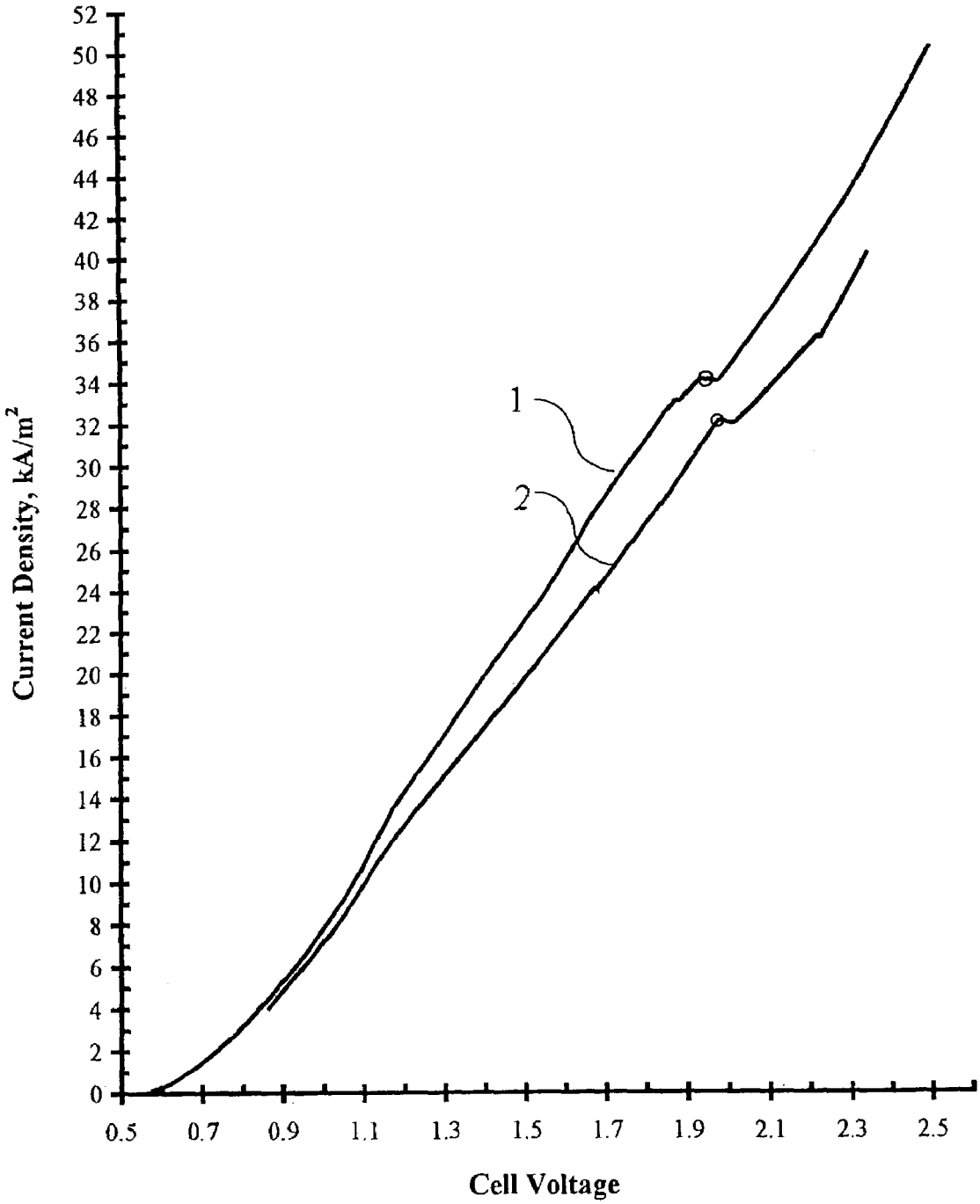
FIGS. 5 and 6 are graphs of cell voltages plotted against current densities for different embodiments.

Experiment-F, Curve 1, FIG. 5. Experiment-A was repeated having the cell assembled with the same components but the width of the pockets and components in the terminal plates were reduced to half of the original width by inserting vertical strips of PTFE on either side. The projected active area of the cell was 3.8 cm wide by 5.3 cm high to provide a 20 cm$^2$ area. This reduced the active membrane area by half to 20 cm$^2$ allowing for a greater range of current density with the same power supply. The same operating conditions were used as in Experiment-A but flowrates were also reduced to half. The start of cathode gas evolution was observed in the current density range of 34 kA/m$^2$ to 36 kA/m$^2$.

Microscopic examination of the carbon fibre materials used as cathode components indicates that the fibres in each material are of similar diameter. On the basis of uniform or average fibre diameter $d_{AVG}$ and the solid specific density $\rho_S$, the surface area of the fibres per unit weight solid $A_S$ (defined as the specific area) can be calculated as $A_S=4/\rho_S/d_{AVG}$. A measurement of the weight of material per unit area $A_{WP}$ (or a real weight) was obtained for each of the different materials. Subsequently the total or real surface area of the fibres per unit of flat dimensional or projected area RSA/PA, can be estimated as $RSA/PA=A_S*A_{WP}$ and is an indication of the "real surface area per unit of projected area" (RSA/PA). The following Table 1 summarises such measurements and calculations.

TABLE 1

| Parameter | Carbon Cloth | Carbon Scrim | Hi-Flow Material 1.1 mm | Hi-Flow Material 1.4 mm |
|---|---|---|---|---|
| Fibre diameter, μm | 7.4 | 7.4 | 7.4 | 7.4 |
| Specific Density, g/cc | 1.75 | 1.75 | 1.75 | 1.75 |
| Aerial density, g/m$^2$ | 122 | 18.1 | 735.3 | 504.1 |
| Specific Area, m$^2$/g | 0.309 | 0.309 | 0.309 | 0.309 |
| RSA/PA, m$^2$/m$^2$ (proj) | 37.7 | 5.6 | 227.1 | 155.7 |

RSA/PA = Real Surface Area (m$^2$) per unit Projected Area (m$^2$)

The two layers of carbon scrim material used in Experiment-C together give a real surface area about 11.2 m$^2$ per m$^2$ of projected area and the current density where hydrogen gas evolution was observed at approximately 4 kA/m$^2$.

Figure 4:
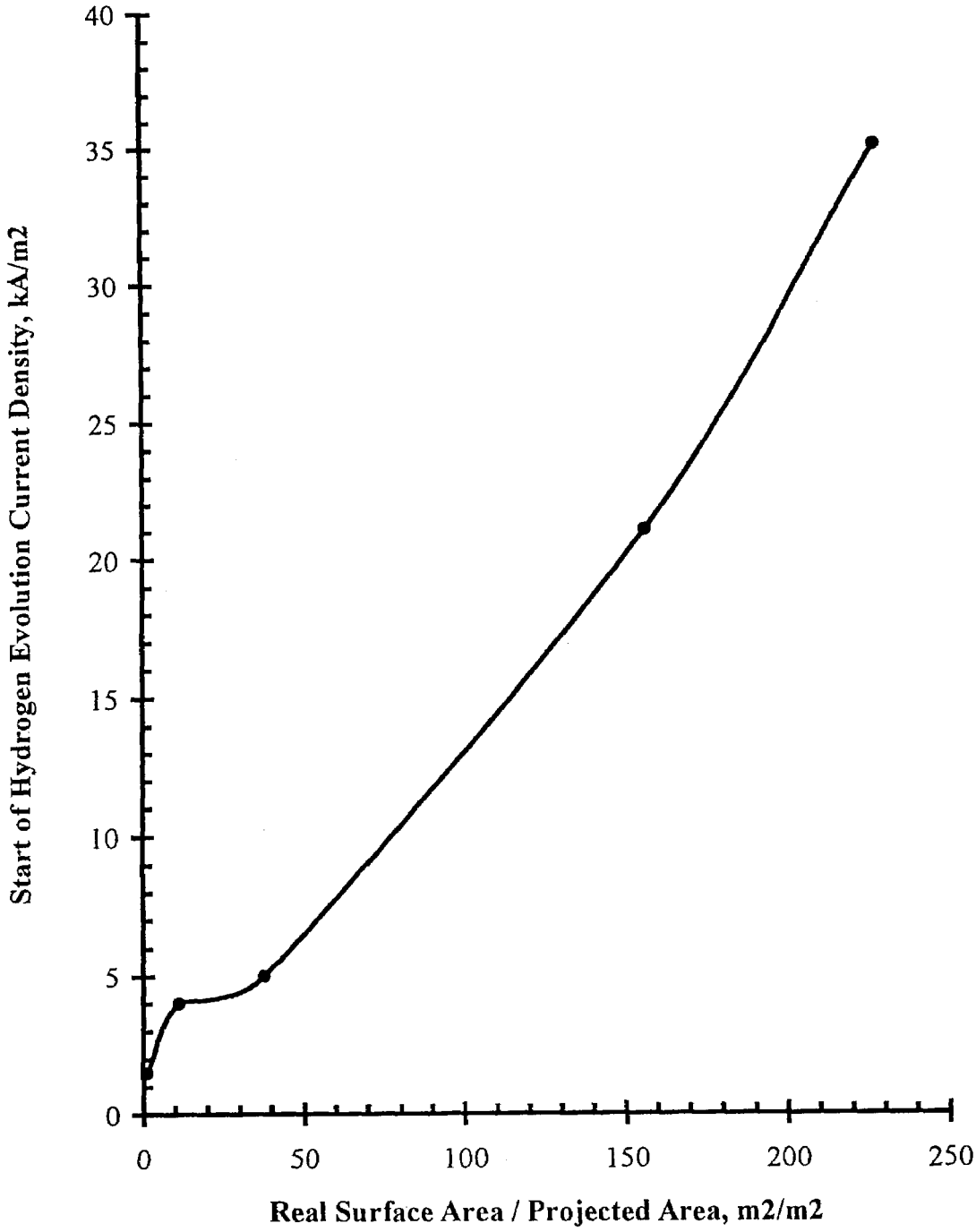
FIG. 4 is a graph of Real Surface Area/Projected Area against hydrogen evolution current density.

The estimated minimum current density at which hydrogen evolution starts for the different fibrous materials used in the experiments are presented in FIG. 4.

The results of these experiments demonstrate that:—

(a) the three dimensional cathode structure in the practise of the invention allows for surprisingly high current densities with a concentrated electrolyte solution, and contrary to the teachings in the prior art;

(b) in the mediated process according to the invention, increasing the ratio of the real surface to the projected area also increases the current density at which unfavourable hydrogen evolution occurs at the cathode; and (c) a ratio of real surface area to projected surface area of about 10 is required to operate the mediated process of the invention for the electrolysis of hydrogen chloride in an aqueous solution to favourably provide current densities of greater than 4 kA/m$^2$.

Example 2

Example 1 Experiment F was repeated with pressures reduced to 41 kPa g (6 psig) for the anolyte exit stream and 7 kPa g (1 psig) for the exit catholyte stream. Current density values are plotted against cell voltages in FIG. 5 as curve 2.

Comparison of cell voltages for Examples 1-F and 2 in FIG. 5 illustrates that operation at reduced pressures results in an increase of voltage. The voltage increase is greater at higher current densities.

Example 3

Two long-term continuous experiments of the cell were conducted to observe what degree of degradation might occur to the carbon fibres of the anode. The degradation of carbon substrates in anodes used to electrolyse hydrogen chloride in aqueous solution has been previously described in the prior art and attributed to the anodic side reaction of water oxidation producing intermediate oxygen radicals during oxygen gas evolution.

Both experiments applied the same current density of 12 kA/m$^2$ and operated at the same cell temperature, pressures, and anolyte flowrates for the electrolysis of hydrogen chloride in an aqueous anolyte. The experiments used the same electrochemical cell assembly as Example 1 with the same but new anode components.

Experiment-A was operated with the mediated process using the same cathode components as for Example 1-A. The catholyte feed solution contained 15% w/w $FeCl_3$ and 3.5% w/w HCl (1.05 M FeCl3 and 1.1 M HCl). The catholyte solution was pumped to the cell at a flow rate of 60 mL/min. The average cell voltage was 1.13. Iron concentration measured in the anolyte solution became a steady-state value averaging about 25 parts per million in the last three weeks of operation. Measurements gave the net water transfer as an average 2.1 moles $H_2O$ per mole hydrogen ion and the estimated HCl transfer from anolyte to catholyte was about 0.5 kg/hr/$m^2$.

After six weeks (~1035 hours), the catalysed carbon cloth serving as the anode was inspected using scanning electron microscopy. All carbon fibres of the catalysed carbon cloth anode were found to be no different in appearance or size compared to a new carbon cloth, which indicates that no degradation occurred due to oxygen attack.

Experiment-B was operated with hydrogen evolution using the same cathode components as for Example 1-A plus a RuO2 catalysed carbon cloth. The catholyte feed solution contained 20% w/w HCl (1.1 M HCl). The catholyte solution was pumped to the cell at a flow rate of 60 milliliters per minute. The cell voltage averaged 1.77. Net water transfer rates were estimated to be an average of 3.1 moles $H_2O$ per mole hydrogen ion. Transfer of HCl from anolyte to catholyte was estimated to be an average of 1.2 kg/hr/$m^2$.

After six weeks (~1045 hours), the catalysed carbon cloth serving as the anode was inspected using scanning electron microscopy. At locations towards the exit anolyte port, carbon fibres were noticeably thinner with broken fibres worn to fine points indicating degradation due to oxygen attack.

The lack of carbon fibre degradation in the catalysed carbon cloth serving as the anode in Experiment-A might have been attributed to a low conversion of chloride ion and conditions that were conducive to maintaining an adequate supply of chloride ions to all active sites of the anode. However, carbon fibre degradation was observed notwithstanding a similarly low chloride conversion and other anolyte conditions used in Experiment-B.

Example 3 illustrates the benefit of the cathode reaction and/or catholyte solution of the mediated process according to the invention using iron chloride in obtaining a greater stability of carbon substrate used for the anode in the electrolysis of an aqueous hydrogen chloride solution. There is a measured steady state iron concentration averaging about 25 ppm Fe in the anolyte. Further, that methods of balancing water and HCl transfers from anolyte to catholyte across the membrane are required to obtain an essentially closed process.

Example 4

Example 1-A was repeated with the same electrochemical cell assembly and with the same operating parameters with the exception that the hydrogen chloride concentration of the catholyte solution was increased from 3.0 M HCl to 5.2 M.

The resulting cell voltages versus current densities were slightly higher than the cell voltages obtained in Example 1-A (curve 1 in FIG. 3). Below a current density of 12 kA/$m^2$, the difference in cell voltages with catholyte solutions having the two HCl concentrations was consistent at 30±3 mV higher for the higher acid catholyte. The voltage difference increased linearly with current density from 30 mV at 12 kA/$m^2$ to 100 mV at 32 kA/$m^2$. Green ferrous chloride crystals were observed in the vessel collecting exit catholyte solution where sufficient heat loss had apparently lowered the solution temperature to, or below, the crystallisation point. Operation of the cell with a ferric/ferrous chloride catholyte solution having the higher HCl concentration results in some penalty of increased power consumption. This power consumption penalty will offset savings that might be obtained in accelerated oxidation of ferrous ion. The reduced solubility of the reduced metal ion at higher acid concentration must be considered with respect to possible blockage in the 3D-cathode.

Example 5

Example 1-A was repeated with the same operating parameters and with the same electrochemical cell assembly with the exception that a $RuO_2$ catalysed carbon cloth was added into the cathode chamber next to the membrane. The current density versus cell voltage data closely parallels the current density versus cell voltage data obtained in Example 1-A (curve 1 in FIG. 3).

Cell voltages with the catalysed cathode component were slightly lower than cell voltages with no catalysed cathode component by an average of 16 milli-volts (0.016 volt) with a standard deviation of 12; the difference is not significant.

This example indicates that the electrochemical activity of the $RuO_2$ catalyst for reduction of ferric ions is quite similar to carbon while the operation of the cell with no special cathode electrocatalyst is advantageous towards lower capital and lower operating costs associated with the catalyst renewal.

Example 6

Experiments were done to consider the use of a copper chloride solution for the catholyte with and without a catalysed cathode component. The experiments used the same electrochemical cell assembly as in Example 1-A except for experiments B and D in which a $RuO_2$ catalysed carbon cloth was added into the catholyte chamber next to the membrane. The cell was operated with the same temperature and pressures.

Experiment 6-A: 2.55 M $CuCl_2$, 2.35 M HCl. 3D-cathode only.

An initial attempt was made to adjust the catholyte flowrate for a 50% conversion of cupric ion. Cell voltages were increasingly erratic and crystals were observed in the exit catholyte tubing (later determined to contain cuprous chloride). Operation was adjusted for a 30% conversion of cupric ion. Current density values are plotted against cell voltages in FIG. 6 as curve 2. The data for Example 1-A ($FeCl_3$—$FeCl_2$—HCl—$H_2O$ catholyte) is plotted as curve 1 in FIG. 6 for comparison. The current density versus cell voltage pattern for operation with the cupric chloride catholyte solution (curve 2) is not parallel to the pattern for operation with ferric chloride catholyte solution (curve 1) although the cell voltages are generally comparable. The difference in the patterns of the two curves can be attributed mostly to the different reducible metal ion conversions used in the two examples.

Experiment 6-B: Experiment 6-A with a $RuO_2$ catalysed carbon cloth cathode. The catholyte conversion of cupric chloride was 30%. The current density versus cell voltage data is shown as curve 3 in FIG. 6.

Experiment 6-C: 2.0 M $CuCl_2$, 0.6 M CuCl, 2.9 M HCl, and 3D cathode only.

With a lower cupric ion concentration, the catholyte flowrate is higher than used in Experiment 6-A to maintain the same 30% cupric ion conversion. The current density versus cell voltage data is shown as curve 4 in FIG. 6. The cell voltages are noticeably higher than those obtained in Experiment 6-A illustrating a difference caused by lowering reducible cupric ion concentration and increasing the concentration of the reduced ion (cuprous).

Experiment 6-D: Experiment 6-C with $RuO_2$ catalysed carbon cloth cathode.

Figure 6:
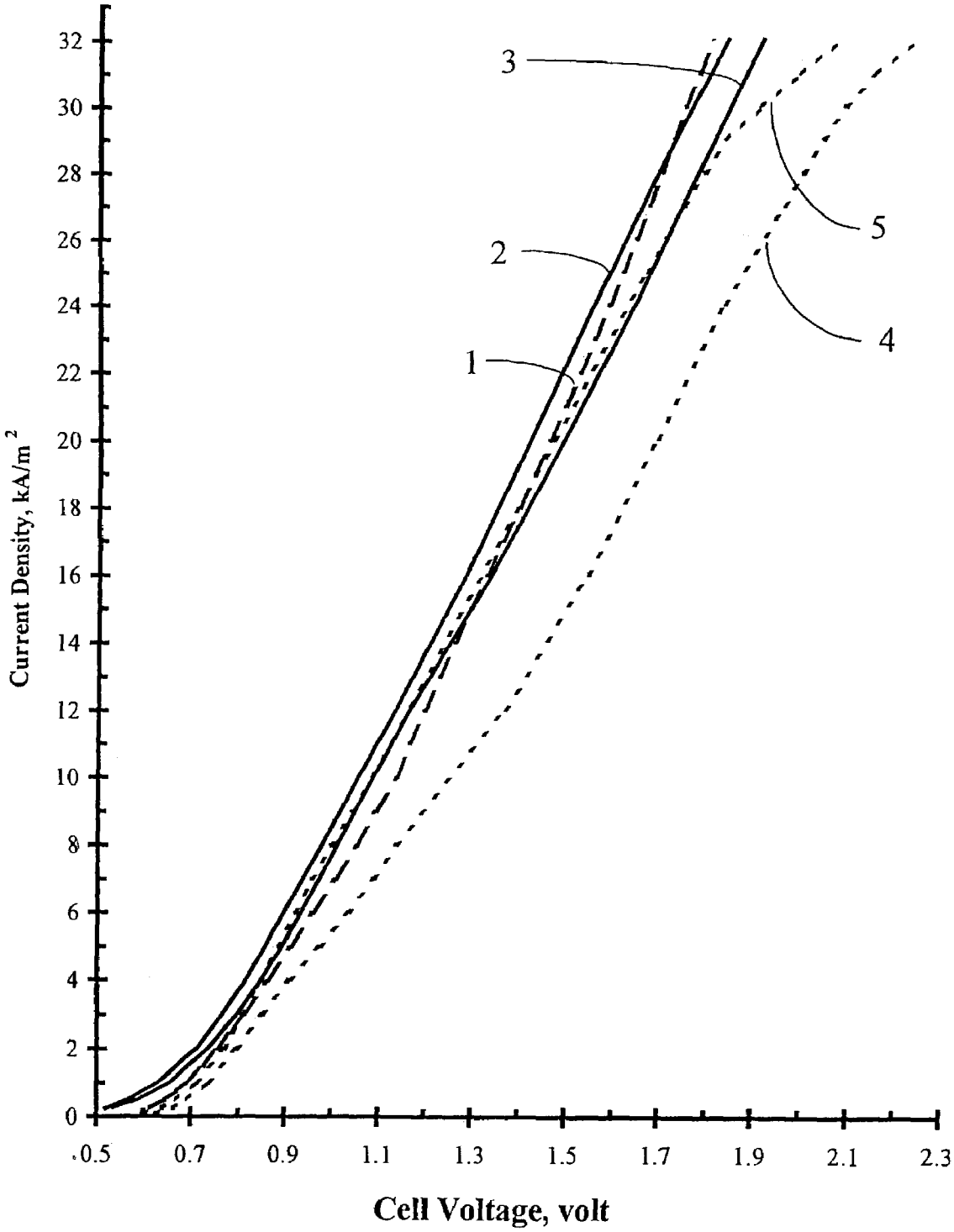

The current density versus cell voltage data is shown as curve 5 in FIG. 6.

The cell voltages with the cupric/cuprous catholyte solution used in experiments C and D are noticeably reduced with a catalysed cathode component (FIG. 6, curve 5—catalysed versus curve 4—no catalyst). The catalysed component also results in a smaller but still noticeable reduction of the cell voltages with only cupric catholyte solution (FIG. 6, curve 3—catalysed curve 2—no catalyst). Example 5 illustrated that a catalysed cathode component had no significant effect on cell voltages using a ferric/ferrous catholyte solution. It further illustrates that the economic advantages of not using a catalysed cathode can be obtained with a ferric/ferrous catholyte solution having considerable ferrous ion concentration in the feed catholyte solution. Further, for comparable cell voltages (power consumptions) without using a catalysed cathode, the cuprous ion concentration of a cupric/cuprous catholyte feed solution must be minimised.

Example 7

Two experiments were conducted to consider the effect of a mixed metal ion solution on cell for the mediated process. Experiment 1-A was repeated with the same electrochemical cell assembly and with the same operating parameters with the exception that the catholyte solution was an aqueous solution containing iron and copper chlorides.

Experiment 7-A: The catholyte solution contained 0.2 M $CuCl_2$, 1.6 M $FeCl_3$, 0.7 M $FeCl_2$, and 3.0 M HCl. The total concentration of reducible metal ions is 1.8 moles $CuCl_2$/$FeCl_3$ per liter, which is comparable to the concentration of reducible ferric ions in the catholyte solution used in Experiment 1-A. The catholyte flowrate was adjusted as in Experiment 1-A to achieve a 50% conversion of the total reducible metal ion content entering the cell.

Current densities versus cell voltages give the same curve as the cell voltages obtained in Experiment 1-A with no added cupric chloride. (curve 1 in FIG. 3).

Experiment 7-B: Cupric and ferric ion concentrations of the catholyte solution were adjusted. The total reducible metal ion concentration was maintained as 1.8 moles $CuCl_2$/$FeCl_3$ per liter with 0.5 M $CuCl_2$ and 1.3 M $FeCl_3$. Cell voltages versus current densities were essentially the same as the cell voltages obtained in Experiment 1-A and Experiment 7-A. Similar with the results of Experiment 7-A, the plotted data of this example results in a curve that is essentially indistinguishable from the plotted data for Experiment 1-A (curve 1 in FIG. 3).

Although cupric and ferric ions are both reducible, no cuprous ions were detected in the catholyte exit streams of Experiment 7-A and Experiment 7-B. This observation could be expected due to the known oxidation of cuprous ions by ferric ions.

The data shows that adding cupric chloride in significant concentrations to a ferric/ferrous chloride catholyte solution neither increases or decreases cell voltage. With respect to the power consumption, there is no advantage or disadvantage in using a mixed iron/copper chloride catholyte compared to catholyte solutions of either metal chloride alone.

Example 8

Experiments were conducted using an agitated, baffled, high-pressure reactor with a nominal capacity of 1 liter constructed of titanium for all wetted parts including the shaft-sealed agitator, baffles, internal cooling coil, thermocouple equipped thermowell, and tubes to a pressure sensor and to isolation valves on inlet and outlet ports. The reactor system is available from Autoclave Engineers, a division of Snap-tite Incorporated, Erie, Pa., U.S.A. and included dual temperature controller for a heating mantle and cooling water valve, agitator speed control, plus instrumentation for recording the monitored parameters. The reactor was equipped with a gas-dispersing agitator, designated as the product Dispersimax, having a hollow shaft section with openings to the upper section or vapour space of the reactor vessel and to a bottom impeller. Gas in the vapour space of the reactor is drawn into and down the hollow shaft and dispersed into the liquid contents. The liquid volume in the reactor was restricted to 700 milliliters.

Oxygen and nitrogen gases from high-pressure cylinders were connected to the vapour space of the reactor. A thermal mass flowmeter was used to monitor and record gas flowrates to the reactor.

Results of the batch reactor examples are summarised in following Table 2.

TABLE 2

| Parameter | Temp | $O_2$ Pres | Agitator Speed | Stock Concentrations (moles per liter) | | | Time for 60% Conversion |
|---|---|---|---|---|---|---|---|
| Varied | ° C. | atm | Rpm | Fe(II) | Fe(III) | HCl | minutes |
| Agitator Speed | 60 | 2 | 2000 | 1.00 | 1.45 | 2.84 | 19.8 |
| | | | 2500 | | | | 17.12 |
| | | | 3000 | | | | 13.83 |
| Oxygen Pressure | 60 | 1 | 3000 | 1.00 | 1.45 | 2.84 | 47.3 |
| | | 2 | | | | | 13.83 |
| | | 5 | | | | | 4.90 |
| HCl Concentration | 60 | 2 | 3000 | 0.84 | 1.21 | 3.41 | 8.08 |
| | | | | | | 3.75 | 6.06 |
| | | | | | | 5.69 | 2.42 |
| Metal | 60 | 2 | 3000 | Fe(II) | Fe(III) | HCl | |

TABLE 2-continued

| Parameter Varied | | Temp ° C. | $O_2$ Pres atm | Agitator Speed Rpm | Stock Concentrations (moles per liter) Fe(II) | Fe(III) | HCl | Time for 60% Conversion minutes |
|---|---|---|---|---|---|---|---|---|
| Ion | | | | | 1.44 | 0.87 | 3.58 | 12.35 |
| | | | | | Cu(I) | Cu(II) | HCl | |
| | | | | | 1.14 | 1.19 | 3.39 | 2.20 |
| Copper | 0 | 90 | 5 | 3000 | 0.46 | 0.62 | 1.84 | 7.70 |
| ($Cu^{2+}$) | 0.05 | | | | | | | 3.88 |
| Addition | 0.2 | | | | | | | 1.90 |

A common procedure was used in all examples. Nitrogen gas was used to purge the empty reactor to atmosphere before a weighed solution volume was added and the solution was heated to the desired temperature. The agitation was stopped, nitrogen was isolated, the reactor was sealed at atmospheric pressure, and oxygen was introduced to the desired partial pressure. Reaction time zero corresponded with the initiation of agitation. Recorded oxygen flow rates were integrated for the accumulated oxygen uptake and the result was ±5% in agreement with the expected consumption determined from solution and sample weights and ferrous ion analysis in accordance with the stoichiometric reaction:

$$4FeCl_2+4HCl+O_2 \square 4FeCl_3+2H_2O$$

Published studies of reaction kinetics for the oxidation of ferrous ions using oxygen focus on solutions with dilute concentrations of ferrous ion and use experimental conditions that avoid, or provide definition of mass transfer effects. A comprehensive analysis of our results for determination of the mass transfer characteristics of the system and reaction kinetic parameters is complicated by the high component concentrations, which are of relevance to the overall process. We found that comparison of the time for 60% conversion of the reduced metal ion (ferrous or cuprous) was sufficient for purposes of indicating desirable conditions for a practical process.

The results obtained for different agitator speeds, within equipment capabilities, illustrate limitations of the agitated reactor to maintain a constant oxygen concentration in the solution. If mass transfer of oxygen into the solution were not a limiting factor, the times would plateau at a constant value versus increased agitator speed. The mass transfer limitation is more apparent for other conditions that increase the reaction rate such as higher ferrous concentrations, higher temperature, and higher oxygen pressure. Kovacs (Great Britain Patent 1365093, filed Jul. 14, 1971) describes vigorous mechanical agitation as being essential for obtaining reasonable ferrous chloride oxidation rates using oxygen.

In dilute solutions, literature studies find significant increase of ferrous oxidation rate with increases in oxygen pressure, in reaction temperature, in hydrogen chloride concentration, and with additions of other metal ions such as tin and copper. For higher ferrous concentrations, and including higher ferric ion concentrations, of relevance to the contemplated process, the results of these examples verify that significant increase of ferrous oxidation rate is still obtained.

In the examples comparing oxidation rates for ferric/ferrous and cupric/cuprous solutions, preparation of solutions with equal initial molar concentrations of the components was attempted. However, oxidation of cuprous ion through contact with air could not be sufficiently suppressed in the preparation and transfer steps to maintain similar concentrations. The resulting times of 60% conversion for the examples with the two metal ion solutions still indicate a much faster oxidation rate for cuprous ions although the lower initial cuprous chloride content in the reactor contributes to a reduced time. However, the mass transfer limitation could also be readily observed in the data for the cupric/cuprous example. The initial oxygen flowrate quickly became a very high value compared to all other examples and remained nearly constant for a significant portion of the time period before rapidly diminishing. Thus if the equipment were able to provide a much higher mass transfer rate of oxygen, the 60% conversion time for the cupric/cuprous example would have been substantially reduced.

The examples with cupric chloride added to a ferric/ferrous chloride solution illustrate a beneficial increase of ferrous oxidation rate. A cupric concentration of 0.05 M $CuCl_2$ reduced the 60% ferrous conversion time by ½ and a fourfold increase of cupric concentration to 0.2 M $CuCl_2$ reduced the 60% ferrous conversion time by another ½. The reduction in the times versus cupric concentrations indicates a diminishing benefit of higher cupric concentrations.

Various workers using additives and combinations of additives have described a beneficial increase of ferrous oxidation rates. However, the discussions of different workers give contradictory information, which might be caused by the nature of the media as well as experimental methods. Sulphate and chloride are the most common media. In chloride media, Kovacs (Great Britain Patent 1365093, filed Jul. 14, 1971) claimed beneficial ferrous oxidation rates using dissolved promoter cations consisting of ammonium, chromium, cobalt, copper, manganese, nickel, zinc, or mixtures thereof. Kovacs preferred a dual combination of ammonium ions plus one of the metal ions, particularly copper and cupric ions. The process conditions included elevated temperatures (120° C. to 500° C.) and superatmospheric pressures (example of 100 psig), but HCl concentration was preferably low and even reduced by adding finely divided iron oxide particles to react with HCl. With low HCl, some insoluble ferric oxide may form which is not suitable as feed to a 3D-cathode. The use of other additives that could increase ferrous ion oxidation rates is of interest if there are no resulting conditions disadvantageous to the overall process. Such disadvantages include increased cell voltage, reduced solubility of solution components, or potential hazards. A potential hazard may be caused by the addition of ammonium ions wherein, migration from the catholyte to the anolyte could result in the formation of nitrogen trichloride impurity in chlorine gas. Accumulations of nitrogen trichloride that might arise in chlorine processing or storage steps are dangerously explosive.

Additives dissolved into the catholyte solution that increase the ferrous oxidation rate are termed homogeneous catalysts. Heterogeneous or insoluble catalysts such as activated carbon in various forms have also been proposed. Posner (Trans. Fara. Soc.; vol. 49, 1953, pp. 389-395) showed a linear increase of the reaction velocity with increasing amounts of charcoal catalyst addition. The charcoal was dispersed in the solution of a vigorously shaken reactor system. An agitated reactor with a dispersed, fine heterogeneous catalyst is not to be preferred in an electrochemical process employing a 3D-electrode since the catalyst particles must be removed thoroughly from feed solution to the cell. However, the following Examples illustrate the use of a heterogeneous catalyst in a fixed bed reactor, which is attractive due to mechanical simplicity compared to agitated reactor.

Example 9

Experiments were conducted using a flow through reactor constructed of flanged, 3 inch nominal 3 size, poly-tetra-fluoro-ethylene (PTFE) lined carbon steel pipe. Titanium screen elements were inserted in either end to retain a fixed bed of particles in the reactor. Inlets and exit ports were installed for solution inlet, nitrogen or oxygen gas inlet, and a common gas-liquid exit. Solution and gas flows through the reactor were co-current. Inlet gas flowrates were measured and controlled to setpoint with a thermal mass flow meter. Inlet solution was pumped through heaters for a feed temperature automatically controlled to the desired setpoint. The reactor was wrapped with electrical heating tape controlled for the desired exit temperature. The exit gas-liquid pressure was also controlled to a desired setpoint.

The reactor was filled with extruded pellets of activated carbon available from Norit Americas Incorporated (Atlanta, Ga., U.S.A.) as the product designated Norit® RX3 Extra. The pellets measure 3 millimeters diameter by typically 9-12 millimeters long and specifications include minimum specific area of 1370 $m^2/g$. A bulk volume of 4 four liters of the pellets filled the reactor. Approximately 2.1 liters of water filled the fixed bed reactor.

Results of the continuous reactor examples are summarised in the following table illustrating an increase in the conversion of ferrous chloride with temperature. The results of these examples were obtained with a once-through feed solution containing 0.49 moles $Fe^{2+}$ per liter, 0.51 moles $Fe^{3+}$ per liter, and 2.25 moles HCl per liter. Common operating conditions were used for a feed solution flow rate of 70 milliliters per minute; a pure oxygen feed flowrate of 0.193 standard liters per minute; and an exit pressure of 414 kPa g (60 psig) or approximately 5 atmospheres absolute. The oxygen flowrate was chosen as the oxygen consumption rate for 100% conversion of ferrous chloride. In these examples, space-time, or the time required to process one reactor volume of feed (both solution and gas) measured at actual conditions, based on an actual reactor fluid volume of 2.1 liters is reported in the table. The conversion of ferrous chloride was determined by analysing exit solution samples at periodic time intervals after the introduction of oxygen and the steady-state value is reported in the table below. The steady state conversion value was obtained after 80 to 90 minutes of continuous flow.

| Temp. (° C.) | Space-time (minutes) | $Fe^{2+}$ Conversion (%) |
|---|---|---|
| 20 | 18.9 | 7% |
| 60 | 17.9 | 23% |
| 90 | 17.3 | 41% |
| 105 | 17.0 | 49% |

Since definitive expressions for reaction kinetics and mass transfer were not available the effect of carbon (heterogeneous catalyst) and the effect of cupric chloride (homogeneous catalyst) could be only qualitatively compared for the two reactor systems by simple inference using the reaction times. The batch reactor examples with cupric chloride added to solutions of comparable ferric/ferrous chloride concentrations were operated at 90° C. and the same oxygen pressure of 5 atmospheres. The batch reaction times with added cupric chloride are given for 60% ferrous conversion that is greater than conversions obtained with the batch reactor. Greater time would be expected for greater conversion but even with this disadvantage, the batch reaction times were all much shorter than the space-times in the continuous carbon filled reactor. Although the addition of cupric chloride would appear to be of greater benefit, this simple comparison does not allow for a conclusion that carbon is not useful for increasing ferrous oxidation rate. The fixed bed reactor as described above was particularly convenient for the laboratory set-up of the electrochemical process complete with a continuous circulation of catholyte solution including ferrous oxidation using oxygen and balancing water and hydrogen chloride in an essentially closed system as described in the following example 10.

Example 10

The experiment illustrates an essentially closed mediated process for the electrolysis of hydrogen chloride in an aqueous solution.

The electrochemical cell is assembled as for Experiment 1-A and is operated for a period of 150 hours (about six days). Anolyte solution is circulated with addition of pure anhydrous HCl gas to the cell feed stream. A water make-up stream consisting of a water condensate stream containing HCl is obtained from exit vapours of the catholyte circulation system as described in the following. The flowrate of the water make-up stream into the anolyte system is adjusted to maintain a constant level in the anolyte solution circulation vessel. A constant flowrate of anhydrous HCl is based on stoichiometric conversion to chlorine according to 100% efficiency of the current applied to the cell.

Direct current is applied to the cell and increased to a constant value of 48 amperes giving a current density of 12 $kA/m^2$. The applied current results in a 9% conversion of total chloride entering the cell to chlorine gas at the anode.

The interior cell temperature is controlled to 70° C. The pressure of anolyte HCl solution and chlorine gas exiting the cell is controlled at 207 kilo-Pascal gauge (kPa g) (30 psig).

An aqueous solution containing 1.75 M $FeCl_3$, 0.05 M $CuCl_2$, 0.7 M $FeCl_2$, and 3 M HCl is used to fill the catholyte system. The total reducible metal ion concentration is initially 1.8 M $FeCl_3/CuCl_2$. The catholyte solution is initially pumped to the cell at a flow rate of 33 milliliters per minute to obtain about 50% conversion of the total reducible metal ion when a current of 48 amperes is applied to the cell. The catholyte feed solution is analysed on a routine basis and the catholyte flowrate adjusted to maintain 50% conversion of reducible metal ion. After three days of balancing the system, the feed catholyte solution averages about 1.70 M $FeCl_3$, 0.05 M $CuCl_2$, 0.77 M $FeCl_2$ and 3 M HCl for the remaining three days of operation. A flowrate of 34 milliliters per hour is then set for 50% reducible metal ion conversion in the cell.

The exit catholyte solution is collected in a vessel designated as the Regeneration Feed Tank and pumped at constant flowrate to a series of fixed bed reactors for oxidation of ferrous ions using pure oxygen. After balancing the catholyte system, the analysis of exit catholyte solution averages about 0.8 M $FeCl_3$, 0.05 M $CuCl_2$, 1.57 M $FeCl_2$ and 3.77 M HCl.

Three fixed bed reactors filled with carbon as described in Example 9 are connected in series with respect to flow of the catholyte solution. The temperature of the feed solution to the first reactor and the exit temperature of each reactor is controlled to a temperature of 105° C. The pressure of solution exiting the third reactor is controlled at 414 kPa g (60 psig) or approximately 5 atmospheres absolute. The reactors are connected in parallel with respect to pure oxygen gas that is distributed to the three reactors through rotameters from a thermal mass flow controller. The total oxygen flowrate is set as the consumption rate necessary for conversion of sufficient ferrous ions to obtain a regenerated feed catholyte solution. The amount of ferrous ions to be converted is determined from the current applied to the cell and the total oxygen flowrate is obtained according to the stoichiometry:

$$4FeCl_2+O_2+4HCl \square 4FeCl_3+2H_2O$$

The necessary total oxygen flowrate is determined as 0.167 SLPM. The water produced according to this stoichiometry is 0.27 grams per minute.

A equal distribution of oxygen to the three reactors results in essentially no gas passing from the first reactor to the second, very little gas passing from the second reactor to the third, and a larger amount of oxygen gas exiting from the third reactor. Distributing the total oxygen equally but only to the first two reactors results in very little gas passing from the first reactor to the second and a larger amount passing from the second reactor to the third but very little gas exits the third reactor. Within the accuracy of measured quantities, the results indicate nearly 100% consumption of the added pure oxygen. Based on the total amount of ferrous ion to the reactors, the conversion of ferrous ions in the three reactors is about 53%.

The results of the previous Example 9 for the oxidation of ferrous ion using oxygen in the reactors with fixed beds of carbon suggested that the sufficient oxidation of ferrous ions could not occur unless an excess of oxygen gas is passed through the reactors. The excess gas would contribute additional intermingling of the oxygen and solution. However, the small substitution of cupric chloride for ferric chloride in this example appears to facilitate an adequate ferrous ion conversion, perhaps through some mechanism of improved oxygen mass transfer.

The regenerated catholyte solution from the third reactor is passed through a filter comprised of a cylindrical filtration element with a hollow perforated core on which is wound polypropylene yarn and rated for 99% removal of 5 micron particles. The filter element is housed in a PTFE lined carbon steel pipe housing with appropriate end fittings for passing solution through the polypropylene yarn into the hollow core. Inspection of the filter after operation shows a small amount of fine carbon particles embedded in the filter element.

The regenerated and filtered catholyte solution passes to a simple evaporator operated at atmospheric pressure. The evaporator is comprised of a lower section of titanium pipe wrapped with electrical heat tracing and insulation, and an upper section of PTFE lined carbon steel pipe wrapped with insulation only. The regenerated catholyte solution enters the evaporator between the two sections and flows downward in the lower heated section. Solution exits the lower section through tubing arranged as a seal loop to maintain a liquid level in the evaporator just above the top of the lower heated section, and flows into a vessel designated as the Catholyte Feed Tank. The solution temperature in the lower heated section is monitored and the heat input is adjusted to cause a greater or lesser amount of vaporisation as described further in the following. The temperature of the solution in the lower heated section remained essentially constant at about 105° C.

Vapours and any gas from the reactors is taken from the top section of the evaporator through PTFE tubing to a condenser cooled with water of 10° C. There is considerable condensation in the tubing between the evaporator vapour outlet and the condenser due to heat loss. A separation tee and a seal loop of tubing allows for removal and collection of the condensate before the condenser. Additional condensate is collected from the exit vapour tubing of the condenser. There is very little gas flow exiting from the condenser. The condensate streams are collected in separate containers and, routinely, at timed intervals, separately weighed then analysed for metal ions and hydrogen chloride. After a balance is achieved in the overall system in about three days of operation, the average flowrates of condensate are about 1.07 grams per minute from the first separation and about 0.54 grams per minute from the condenser exit. The average HCl concentrations are determined as 4.17% w/w and about 0.04% w/w, respectively. Metal ions are not detected. A larger amount of HCl in the condensate streams might occur except that heat loss from the upper section of the evaporator is suspected to cause an internal condensation that is comparable to having a reflux condenser returning condensed vapours back into the evaporator.

A portion of the collected second condensate stream that is equivalent to the accumulation of water produced by the oxidation of ferrous ions using oxygen in the timed collection interval is removed. The remaining portion of the second condensate stream is combined with the collection of the first condensate stream. The combined condensate is added to the vessel holding make-up water for the anolyte system.

A balance of the overall system is achieved by summing the estimated flowrates of the condensate streams of the evaporator in the catholyte system and subtracting the rate of water production determined for the oxidation of ferrous ions using oxygen according to the stoichiometry presented above. The resultant flowrate is compared to the measured flowrate of make-up water added to the anolyte system; the latter flowrate adjusted to maintain a constant level in the anolyte solution circulation vessel. If the adjusted total condensate flowrate is less than the water make-up flowrate, then the evaporator heat input is increased. Conversely the reverse result prompts the reverse action.

Some losses of water and HCl are expected in the overall system, mostly in vented gases from the anolyte gas-liquid separation into produced chlorine and from the chlorine stripping of the anolyte solution. The temperatures at these points are near ambient due to large heat losses in a small system, which makes these losses of water and HCl very small. Consequently, the estimated membrane transfers are 2.5 moles water per mole $H^+$ and 0.7 kilograms HCl per hour per square meter of active membrane area.

The cell voltage rises during the six days of operation from an initial daily average value of 1.192 volts to 1.195 volts. The voltage trend indicates a declining rate of increase. In this example, operating at a current density of 12 $kA/m^2$, the power consumption is 905 kWh/tonne $Cl_2$.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

The invention claimed is:

1. A process for the production of a halogen gas by the electrolysis of an aqueous hydrohalic acid solution in an electrolytic cell, said cell comprising an electrocatalyst-containing anode; a cathode; an anolyte chamber; a catholyte chamber; an ion-exchange membrane separating said anolyte chamber from said catholyte chamber and not bonded to one or both of said anode and said cathode;

said process comprising (a) feeding an aqueous hydrohalic acid feedstock to said anolyte chamber;

(b) feeding an aqueous catholyte feedstock to said catholyte chamber, said catholyte feedstock comprising a metal ion species in a first oxidation state operably reducible to a lower and second oxidation state at said cathode to produce a catholyte effluent containing said reduced metal ion species;

(c) operably producing said halogen gas at said anode within said anolyte chamber and a depleted hydrohalic acid effluent;

(d) collecting said halogen gas and said depleted hydrohalic acid effluent;

the improvement wherein said cathode comprises a non-catalyzed 3-dimensional electroconductive comprising one or more layers of porous structure made of electroconductive material resistant to acidic metal ion solution, said porous cathode having a thickness in the range of 0.5 to 10 millimeters providing a cathodically effective surface area of at least ten times its projected area, and said catholyte feedstock is passed through said porous cathode.

2. A process as defined in claim 1 wherein said anode is a 2-dimensional anode having a surface area equal to the projected area.

3. A process as defined in claim 1 wherein said anode is a 3-dimensional anode having a surface area greater than the projected area.

4. A process as defined in claim 1 wherein said cell is operating at a current density of greater than 4 $kA/m^2$.

5. A process as defined in claim 4 wherein said cell is operating at a current density of greater than 10 $kA/m^2$.

6. A process as defined in claim 1 wherein said portion of said cathode comprises a material selected from the group consisting of carbon, a metal carbide, a metal nitride, a metal boride, a conductive metal oxide and hydrochloric acid stable metal alloy.

7. A process as defined in claim 1 wherein said reducible metal ion is selected from $Fe^{+3}$, $Cu^{+2}$ and combinations thereof.

8. A process as defined in claim 1 wherein at least a portion of said catholyte effluent is recycled through an oxidiser and said metal ion species in said lower oxidation state is oxidised to said first oxidation state in said side stream prior to recycle back to said catholyte chamber.

9. A process as defined in claim 8 wherein said oxidiser uses oxygen-containing gas.

10. A process as defined in claim 8 wherein a portion of water contained in said oxidised catholyte effluent is removed prior to recycle to said catholyte chamber.

11. A process as defined in claim 8 wherein a portion of hydrogen halide contained in said oxidised catholyte effluent is removed prior to recycle to said catholyte chamber.

12. A process as defined in claim 8 wherein removal of said portions of water and hydrogen halide contained in said oxidised catholyte effluent is accomplished by means of flash evaporation.

13. A process as defined in claim 8 wherein the portions of water and hydrogen halide removed from said oxidised catholyte effluent, in whole or in part, are added to the anolyte.

14. A process as defined in claim 1 wherein said anolyte in said anolyte chamber contains 5-500 ppm of said metal ions.

15. A process as defined in claim 1 wherein said catholyte contacts said cathode in a "flow-through" mode.

16. A process as defined in claim 1 wherein said catholyte contacts said cathode in a "flow-by" mode.

17. A process as defined in claim 1 wherein said cell operates compartment are under a pressure greater than atmosphere.

18. A process as defined in claim 1 wherein said halogen is chlorine and hydrohalic acid is hydrochloric acid.

19. A process as defined in claim 1 wherein the membrane is not bonded to either said anode or said cathode.

20. A process as defined in claim 1 wherein the membrane is not bonded to only one of said anode and said cathode.

21. A process for the production of a halogen gas by the electrolysis of an aqueous hydrohalic acid solution in an electrolytic cell, said cell comprising an electrocatalyst-containing anode; a cathode; an anolyte chamber; a catholyte chamber; a solid polymer electrolyte membrane separating said anolyte chamber from said catholyte chamber;

said process comprising (a) feeding an aqueous hydrohalic acid feedstock to said anolyte chamber;

(b) feeding an aqueous catholyte feedstock to said catholyte chamber, said catholyte feedstock comprising a metal ion species in a first oxidation state operably reducible to a lower and second oxidation state at said cathode to produce a catholyte effluent containing said reduced metal ion species;

(c) operably producing said halogen gas at said anode within said anolyte chamber and a depleted hydrohalic acid effluent;

(d) collecting said halogen gas and said depleted hydrohalic acid effluent;

the improvement wherein said cathode comprises a non-catalyzed 3-dimensional electroconductive cathode comprising one or more layers of porous structure made of electroconductive material resistant to acidic metal ion solution, said porous cathode having a thickness in the range of 0.5 to 10 millimeters providing an extended cathodically effective surface area of at least ten times its projected area, said catholyte being passed through said porous cathode.

* * * * *